US010648330B1

(12) United States Patent
Weaver et al.

(10) Patent No.: US 10,648,330 B1
(45) Date of Patent: May 12, 2020

(54) CUTTING TOOL ASSEMBLIES INCLUDING SUPERHARD WORKING SURFACES, CUTTING TOOL MOUNTING ASSEMBLIES, MATERIAL-REMOVING MACHINES INCLUDING THE SAME, AND METHODS OF USE

(71) Applicant: US SYNTHETIC CORPORATION, Orem, UT (US)

(72) Inventors: Gary Eugene Weaver, Conroe, TX (US); Regan Leland Burton, Saratoga Springs, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 0 days.

(21) Appl. No.: 15/266,355

(22) Filed: Sep. 15, 2016

Related U.S. Application Data

(60) Provisional application No. 62/232,732, filed on Sep. 25, 2015.

(51) Int. Cl.

| | |
|---|---|
| ***E21C 35/19*** | (2006.01) |
| ***E21C 35/193*** | (2006.01) |
| ***E21C 35/183*** | (2006.01) |
| *E21C 35/18* | (2006.01) |
| *E21C 25/10* | (2006.01) |
| *E01C 23/088* | (2006.01) |

(52) U.S. Cl.
CPC ..... *E21C 35/19* (2013.01); *E21C 35/183* (2013.01); *E01C 23/088* (2013.01); *E21C 25/10* (2013.01); *E21C 35/193* (2013.01); *E21C 2035/1803* (2013.01); *E21C 2035/191* (2013.01)

(58) Field of Classification Search
CPC ..... E21C 35/193; E21C 35/1933; E21C 35/1936; E21C 35/19; E21C 35/191; E21C 2035/191
USPC ..... 299/102–106, 110, 111, 113
See application file for complete search history.

(56) References Cited

U.S. PATENT DOCUMENTS

| | | | | |
|---|---|---|---|---|
| 2,665,893 A | | 1/1954 | Ball | |
| 3,342,532 A | * | 9/1967 | Krekeler | E21C 35/19 175/413 |
| 3,544,166 A | | 12/1970 | Proctor | |
| 3,671,075 A | | 6/1972 | Bland et al. | |

(Continued)

FOREIGN PATENT DOCUMENTS

| | | |
|---|---|---|
| AU | 2013101370 | 11/2013 |
| CN | 102108866 | 6/2011 |

(Continued)

OTHER PUBLICATIONS

Advisory Action received for U.S. Appl. No. 14/266,437 dated Mar. 24, 2017.

(Continued)

*Primary Examiner* — David J Bagnell
*Assistant Examiner* — Michael A Goodwin
(74) *Attorney, Agent, or Firm* — Dorsey & Whitney LLP

(57) ABSTRACT

Embodiments of the invention are directed to cutting tool assemblies, cutting tool mounting assemblies, material-removing machines that include cutting tool assemblies and/or cutting tool mounting assemblies, and methods of use and operation thereof. In some embodiments, the various assemblies described herein may be used in material-removing machines that may remove target material.

21 Claims, 12 Drawing Sheets

(56) References Cited

U.S. PATENT DOCUMENTS 3,695,726 A 10/1972 Krekeler
3,751,114 A 8/1973 Davis
3,785,021 A 1/1974 Norgren et al.
3,841,708 A * 10/1974 Kniff ..... E21C 35/19 175/354
D238,243 S 12/1975 Polivka
3,958,832 A 5/1976 Sigott et al.
4,006,936 A 2/1977 Crabiel
4,083,644 A 4/1978 Friedline et al.
4,140,189 A 2/1979 Garner
4,193,638 A 3/1980 Heckenhauer
4,200,159 A 4/1980 Jurgens et al.
4,299,424 A 11/1981 LeBegue et al.
4,303,136 A 12/1981 Ball
4,335,921 A 6/1982 Swisher et al.
4,337,980 A * 7/1982 Krekeler ..... B28D 1/188 175/315
4,340,325 A 7/1982 Gowanlock et al.
D270,059 S 8/1983 Wilkins
D271,497 S 11/1983 Green
4,484,644 A 11/1984 Cook et al.
4,580,930 A 4/1986 Zinner et al.
4,605,343 A 8/1986 Hibbs, Jr. et al.
4,655,508 A 4/1987 Tomlinson
4,678,237 A * 7/1987 Collin ..... E21B 10/567 299/112 R
4,679,858 A 7/1987 Tank
D296,107 S 6/1988 Andersson
4,765,687 A 8/1988 Parrott
4,784,023 A 11/1988 Dennis et al.
4,787,466 A 11/1988 Tomlinson et al.
4,836,178 A 6/1989 Tomlinson
4,850,649 A 7/1989 Beach et al.
4,880,278 A 11/1989 Tomlinson
4,902,073 A 2/1990 Tomlinson et al.
D307,279 S 4/1990 Vincent
4,913,125 A * 4/1990 Bunting ..... E21C 35/19 125/40
D311,747 S 10/1990 Mihic
5,007,685 A 4/1991 Beach et al.
5,060,739 A 10/1991 Griffin et al.
5,090,491 A 2/1992 Tibbitts et al.
5,318,351 A 6/1994 Walker
5,378,050 A * 1/1995 Kammerer ..... E21C 35/193 299/102
5,417,475 A 5/1995 Graham et al.
5,431,239 A 7/1995 Tibbitts et al.
5,605,382 A 2/1997 Massa et al.
5,649,604 A 7/1997 Fuller et al.
5,690,393 A 11/1997 Massa et al.
5,881,830 A 3/1999 Cooley
5,906,245 A 5/1999 Tibbitts et al.
6,089,123 A 7/2000 Chow et al.
6,213,931 B1 4/2001 Twardowski et al.
6,283,844 B1 9/2001 Tank
6,485,104 B1 11/2002 Keller et al.
6,779,850 B1 8/2004 Schibeci et al.
7,108,212 B2 9/2006 Latham
D558,802 S 1/2008 Nicholas
D616,003 S 5/2010 Ueda et al.
7,866,418 B2 1/2011 Bertagnolli et al.
7,998,573 B2 8/2011 Qian et al.
8,034,136 B2 10/2011 Sani
8,047,260 B2 11/2011 Uno et al.
8,079,785 B2 12/2011 Nicholas
8,236,074 B1 8/2012 Bertagnolli et al.
D666,640 S 9/2012 Cox et al.
8,567,533 B2 10/2013 Myers et al.
8,672,415 B2 5/2014 Neilson et al.
8,727,044 B2 5/2014 Qian et al.
8,789,894 B2 7/2014 Claesson et al.
9,017,438 B1 4/2015 Miess et al.
9,027,675 B1 5/2015 Jones et al.
9,028,008 B1 5/2015 Bookhamner et al.
9,238,893 B2 1/2016 Latham et al.
9,272,392 B2 3/2016 Mukhopadhyay et al.
9,272,814 B2 3/2016 Carver et al.
9,303,511 B2 4/2016 George et al.
9,382,794 B2 7/2016 Latham et al.
9,434,091 B2 9/2016 Burton et al.
9,487,847 B2 11/2016 Mukhopadhyay et al.
9,593,577 B2 3/2017 Ries et al.
D809,031 S 1/2018 Burton
10,018,041 B2 7/2018 Wachsmann et al.
10,323,514 B2 6/2019 Burton et al.
10,408,057 B1 9/2019 Myers et al.
2001/0040053 A1 11/2001 Beuershausen et al.
2002/0153175 A1 10/2002 Ojanen et al.
2003/0234569 A1 12/2003 Dawood et al.
2005/0082898 A1 4/2005 Keller et al.
2006/0033379 A1 2/2006 Frear et al.
2006/0087169 A1 4/2006 Hesse et al.
2007/0090679 A1 4/2007 Ojanen et al.
2008/0030065 A1 2/2008 Frear et al.
2008/0035383 A1* 2/2008 Hall ..... E21C 35/183 175/414
2008/0036280 A1 2/2008 Hall et al.
2008/0202819 A1 8/2008 Fader
2008/0250724 A1 10/2008 Hall et al.
2008/0309146 A1 12/2008 Hall et al.
2010/0052406 A1 3/2010 Beach et al.
2010/0194176 A1 8/2010 Lucek et al.
2010/0244545 A1 9/2010 Hall et al.
2010/0326741 A1 12/2010 Patel
2011/0132667 A1 6/2011 Smallman et al.
2011/0148178 A1* 6/2011 Lehnert ..... E02F 9/2816 299/105
2011/0233987 A1 9/2011 Maushart et al.
2011/0266070 A1 11/2011 Scott et al.
2012/0043138 A1 2/2012 Myers et al.
2012/0138370 A1 6/2012 Mukhopadhyay
2012/0160573 A1 6/2012 Myers et al.
2012/0175939 A1 7/2012 O'Neill et al.
2012/0274123 A1 11/2012 Ball
2012/0279786 A1 11/2012 Cox
2013/0052481 A1 2/2013 Konyashin
2013/0092451 A1* 4/2013 Mukhopadhyay ..... B01J 3/062 175/428
2013/0092452 A1 4/2013 Mukhopadhyay et al.
2013/0322975 A1 12/2013 Tan et al.
2014/0110991 A1* 4/2014 Sollami ..... E21C 35/183 299/79.1
2014/0175853 A1* 6/2014 Warren ..... E21C 35/183 299/101
2014/0225418 A1 8/2014 Lachmann et al.
2014/0240634 A1 8/2014 Matsuzaki
2014/0339879 A1 11/2014 Burton et al.
2014/0339883 A1 11/2014 Burton et al.
2015/0035342 A1* 2/2015 Jonker ..... E01C 23/088 299/39.4
2015/0114727 A1 4/2015 Heuser
2015/0176408 A1 6/2015 Latham
2015/0176409 A1 6/2015 Latham
2015/0240635 A1 8/2015 Lachmann et al.
2015/0314483 A1 11/2015 Miess et al.
2016/0102550 A1 4/2016 Swope et al.
2016/0273356 A1 9/2016 Ojanen et al.
2016/0332269 A1 11/2016 Prezlock et al.

FOREIGN PATENT DOCUMENTS

CN 202073564 12/2011
CN 203081445 7/2013
GB 1481278 7/1977
GB 2170843 8/1986
GB 2177144 1/1987
GB 2193740 2/1988
WO WO 2010/083015 7/2010

(56) References Cited

FOREIGN PATENT DOCUMENTS

| | | |
|---|---|---|
| WO | WO 2012/130870 | 10/2012 |
| WO | WO 2016/071001 | 5/2016 |

OTHER PUBLICATIONS

Non-Final Office Action for U.S. Appl. No. 14/266,437 dated Apr. 21, 2017.
Non-Final Office Action received for U.S. Appl. No. 14/275,574 dated Apr. 7, 2017.
Non-Final Office Action for U.S. Appl. No. 29/555,279 dated Mar. 24, 2017.
Notice of Allowance received for U.S. Appl. No. 29/555,269 dated Apr. 6, 2017.
Notice of Allowance received for U.S. Appl. No. 29/555,281 dated Apr. 12, 2017.
Supplemental Notice of Allowance for U.S. Appl. No. 29/555,269 dated Apr. 28, 2017.
Notice of Allowance for U.S. Appl. No. 29/540,584 dated May 8, 2017.
Notice of Allowance for U.S. Appl. No. 29/540,597 dated May 8, 2017.
Supplemental Notice of Allowance for U.S. Appl. No. 29/540,597 dated Jun. 1, 2017.
U.S. Appl. No. 12/961,787, filed Dec. 7, 2010, Mukhopadhyay et al.
U.S. Appl. No. 13/027,954, filed Feb. 15, 2011, Miess et al.
U.S. Appl. No. 13/070,636, filed Mar. 24, 2011, Qian et al.
U.S. Appl. No. 13/100,388, filed May 4, 2011, Jones et al.
U.S. Appl. No. 13/275,372, filed Oct. 18, 2011, Mukhopadhyay et al.
U.S. Appl. No. 13/648,913, filed Oct. 10, 2012, Mukhopadhyay et al.
U.S. Appl. No. 13/765,027, filed Feb. 12, 2013, Carver, et al.
U.S. Appl. No. 13/795,027, filed Mar. 12, 2013, Mukhopadhyay et al.
U.S. Appl. No. 61/824,022, filed May 16, 2013, Burton et al.
U.S. Appl. No. 61/824,007, filed May 16, 2013, Burton et al.
U.S. Appl. No. 14/266,437, filed Apr. 30, 2014, Miess et al.
U.S. Appl. No. 14/273,360, filed May 8, 2014, Burton et al.
U.S. Appl. No. 14/275,574, filed May 12, 2014, Burton et al.
U.S. Appl. No. 62/030,525, filed Jul. 29, 2014, Myers et al.
U.S. Appl. No. 14/811,699, filed Jul. 28, 2015, Myers et al.
U.S. Appl. No. 62/232,732, filed Sep. 25, 2015, Weaver et al.
U.S. Appl. No. 29/540,584, filed Sep. 25, 2015, Weaver.
U.S. Appl. No. 29/540,597, filed Sep. 25, 2015, Weaver.
U.S. Appl. No. 29/555,269, filed Feb. 19, 2016, Burton.
U.S. Appl. No. 29/555,279, filed Feb. 19, 2016, Burton.
U.S. Appl. No. 29/555,281, filed Feb. 19, 2016, Burton.
International Search Report and Written Opinion from International Application No. PCT/US2014/037708 dated Oct. 30, 2014.
International Search Report and Written Opinion from International Application No. PCT/US2014/037381 dated Oct. 30, 2014.
International Search Report and Written Opinion for International Application No. PCT/US2015/027830 dated Jul. 14, 2015.
Roepke et al.; "Drag Bit Cutting Characteristics Using Sintered Diamond Inserts" Report of Investigations 8802; Bureau of Mines Report of Investigations/ 1983; (1983) 35 pages.
U.S. Appl. No. 14/273,360, Jun. 12, 2015, Restriction Requirement.
U.S. Appl. No. 14/273,360, Oct. 22, 2015, Office Action.
U.S. Appl. No. 14/273,360, Mar. 7, 2016, Office Action.
U.S. Appl. No. 14/273,360, May 18, 2016, Notice of Allowance.
U.S. Appl. No. 14/273,360, Aug. 10, 2016, Supplemental Notice of Allowance.
Final Office Action for U.S. Appl. No. 14/266,437 dated Dec. 12, 2016.
Final Office Action for U.S. Appl. No. 14/275,574 dated Nov. 29, 2016.
Issue Notification for U.S. Appl. No. 14/273,360 dated Aug. 17, 2016.
Non-Final Office Action for U. S. Appl. No. 14/266,437 dated Jun. 9, 2016.
U.S. Appl. No. 13/070,636, filed Mar. 24, 2011.
U.S. Appl. No. 15/238,486, filed Aug. 16, 2016.
U.S. Appl. No. 61/824,022, filed May 16, 2013.
Non-Final Office Action for U.S. Appl. No. 14/275,574 dated Apr. 6, 2016.
Advisory Action received for U.S. Appl. No. 14/275,574 dated Mar. 9, 2017.
Final Office Action for U.S. Appl. No. 14/266,437 dated Nov. 15, 2017.
Final Office Action for U.S. Appl. No. 15/238,486 dated Feb. 26, 2018.
Issue Notification for U.S. Appl. No. 29/540,584 dated Sep. 14, 2017.
Issue Notification for U.S. Appl. No. 29/540,597 dated Sep. 6, 2017.
Issue Notification for U.S. Appl. No. 29/555,279 dated Jan. 10, 2018.
Non-Final Office Action for U.S. Appl. No. 14/266,437 dated Mar. 28, 2018.
Non-Final Office Action for U.S. Appl. No. 14/811,699 dated Nov. 29, 2017.
Non-Final Office Action for U.S. Appl. No. 15/238,486 dated Aug. 17, 2017.
Notice of Allowance for U.S. Appl. No. 14/275,574 dated Jan. 24, 2018.
Notice of Allowance for U.S. Appl. No. 14/275,574 dated Sep. 26, 2017.
Notice of Allowance for U.S. Appl. No. 29/555,279 dated Aug. 31, 2017.
Notice of Allowance for U.S. Appl. No. 29/555,281 dated Jan. 4, 2018.
Supplemental Notice of Allowability for U.S. Appl. No. 29/555,279 dated Jan. 2, 2018.
Supplemental Notice of Allowance for U.S. Appl. No. 29/540,584 dated Sep. 7, 2017.
Supplemental Notice of Allowance for U.S. Appl. No. 29/540,597 dated Aug. 25, 2017.
Supplemental Notice of Allowance for U.S. Appl. No. 29/555,281 dated Feb. 9, 2018.
Supplemental Notice of Allowance for U.S. Appl. No. 29/555,281 dated Jun. 12, 2017.
Final Office Action for U.S. Appl. No. 14/266,437 dated Sep. 18, 2018.
Final Office Action for U.S. Appl. No. 14/811,699 dated Jul. 10, 2018.
Issue Notification for U.S. Appl. No. 29/555,281 dated Aug. 29, 2018.
Notice of Allowance for U.S. Appl. No. 14/275,574 dated Jun. 15, 2018.
Notice of Allowance for U.S. Appl. No. 14/275,574 dated Oct. 11, 2018.
Notice of Allowance for U.S. Appl. No. 15/238,486 dated Oct. 10, 2018.
Notice of Allowance for U.S. Appl. No. 15/238,486 dated Jun. 20, 2018.
Notice of Allowance for U.S. Appl. No. 29/555,281 dated May 16, 2018.
Supplemental Notice of Allowance for U.S. Appl. No. 15/238,486 dated Jun. 27, 2018.
Supplemental Notice of Allowance for U.S. Appl. No. 29/555,281 dated Jun. 4, 2018.
U.S. Appl. No. 14/275,574, filed May 12, 2014.
Advisory Action for U.S. Appl. No. 14/811,699 dated Oct. 22, 2018.
Non-Final Office Action for U.S. Appl. No. 14/266,437 dated Jan. 8, 2019.
Non-Final Office Action for U.S. Appl. No. 14/811,699 dated Jan. 4, 2019.
Supplemental Notice of Allowability for U.S. Appl. No. 14/275,574 dated Oct. 31, 2018.
Notice of Allowance for U.S. Appl. No. 15/238,486 dated Jan. 28, 2019.

(56) References Cited

OTHER PUBLICATIONS

Notice of Allowance for U.S. Appl. No. 14/275,574 dated Feb. 12, 2019.
Issue Notification for U.S. Appl. No. 14/275,574 dated May 29, 2019.
Issue Notification for U.S. Appl. No. 15/238,486 dated May 22, 2019.
Non-Final Office Action for U.S. Appl. No. 16/406,673 dated Jun. 27, 2019.
Notice of Allowance for U.S. Appl. No. 14/266,437 dated May 2, 2019.
Notice of Allowance for U.S. Appl. No. 14/811,699 dated May 1, 2019.
Notice of Allowance for U.S. Appl. No. 29/660,512 dated Apr. 25, 2019.
Supplemental Notice of Allowance for U.S. Appl. No. 14/275,574 dated May 21, 2019.
U.S. Appl. No. 16/406,673, filed May 8, 2019.
U.S. Appl. No. 16/527,620, filed Jul. 31, 2019.
Issue Notification for U.S. Appl. No. 14/266,437 dated Aug. 28, 2019.
Issue Notification for U.S. Appl. No. 14/811,699 dated Aug. 21, 2019.
Issue Notification for U.S. Appl. No. 29/660,512 dated Aug. 28, 2019.
Non-Final Office Action for U.S. Appl. No. 16/526,387, dated Oct. 4, 2019.
Non-Final Office Action for U.S. Appl. No. 16/527,620, dated Oct. 2, 2019.
Supplemental Notice of Allowability for U.S. Appl. No. 14/266,437 dated Aug. 19, 2019.
Advisory Action for U.S. Appl. No. 16/406,673 dated Mar. 6, 2020.
Final Office Action for U.S. Appl. No. 16/527,620 dated Mar. 12, 2020.

* cited by examiner

CUTTING TOOL ASSEMBLIES INCLUDING SUPERHARD WORKING SURFACES, CUTTING TOOL MOUNTING ASSEMBLIES, MATERIAL-REMOVING MACHINES INCLUDING THE SAME, AND METHODS OF USE

CROSS-REFERENCE TO RELATED APPLICATIONS

This application claims priority to U.S. Provisional Patent Application No. 62/232,732 filed 25 Sep. 2015, the disclosure of which is incorporated herein, in its entirety, by this reference.

BACKGROUND

Milling and grinding machines are commonly used in various applications and industries, such as mining, asphalt and pavement removal and installation, and others. Such machines may remove material at desired locations. In some applications, material may be removed to facilitate repair or reconditioning of a surface. One example includes removing a portion or a layer of a paved road surface to facilitate repaving. In some instances, the removed material also may be valuable. For example, removed asphalt may be reprocessed and reused. Similarly, in mining operations, removed material may include valuable or useful constituents.

Conventional machines include cutting tools that may cut or grind target material. Typically, such cutting tools are mounted on a rotating drum assembly and engage (e.g., cut and/or grind) the target material as the drum assembly rotates. Failure of the cutting tools may, in turn, lead to the failure of the drum assembly and/or interruptions in operation thereof.

Therefore, manufacturers and users of cutting tools continue to seek improved cutting tools to extend the useful life of drum assemblies and/or reduce or eliminate interruptions in operation thereof.

SUMMARY

Embodiments of the invention are directed to cutting tool assemblies, cutting tool mounting assemblies, material-removing machines that include cutting tool assemblies and/or cutting tool mounting assemblies, and methods of use and operation thereof. In some embodiments, the various assemblies described herein may be used in material-removing machines that may remove target material, such as a portion or a layer of a pavement. For example, a material-removing machine may include a rotary drum, and the cutting tool assemblies and/or the cutting tool mounting assembly may be mounted to or on the rotary drum. Furthermore, as the material-removing machine rotates the cutting tool assemblies together with the rotary drum, the cutting tool assemblies may engage and cut, grind, or otherwise fail the target material, which may be subsequently removed (e.g., by rotary drum assembly of the material-removing machine).

An embodiment includes a cutting tool assembly configured for attachment to a base body on a rotatable assembly of a material-removal machine. The cutting tool assembly includes a support block that includes an elongated mounting shank sized and configured to be secured within the base body. The cutting tool assembly also includes a bolster body fixedly secured to the support block and a cutting element secured to and positioned at least partially within the bolster body. The cutting element has a superhard working surface that includes a superhard material. Moreover the bolster body is sized and configured to protect at least a portion of the cutting element from at least one of erosion or wear during operation of the cutting tool assembly.

At least one embodiment includes a cutting tool mounting assembly. The cutting tool mounting assembly includes a base body sized and configured to be mounted to a rotary drum of a material-removal machine and a cutting tool assembly mounted to the base body. The base body includes a tool recess, and the cutting tool assembly includes a support block that includes an elongated mounting shank positioned in the tool recess of the base body. Moreover, the cutting tool assembly includes a bolster body fixedly secured to the support block and a cutting element secured to and positioned at least partially within the bolster body. The cutting element has a superhard working surface that includes a superhard material, and the bolster body is sized and configured to protect at least a portion of the cutting element from at least one of erosion or wear during operation of the cutting tool assembly.

Embodiments also include a rotary drum assembly. The rotary drum assembly includes a drum body that includes an outer surface and one or more cutting tool mounting assemblies mounted to the drum body. Each of the cutting tool mounting assemblies includes a base body mounted to the outer surface of the drum body and a cutting tool assembly mounted to the base body. The base body includes a tool recess, and the cutting tool assembly includes a support block that includes an elongated mounting shank positioned in the tool recess of the base body. Moreover, the cutting tool assembly includes a bolster body fixedly secured to the support block, and a cutting element secured to and positioned at least partially within the bolster body. The cutting element has a superhard working surface that includes a superhard material, and the bolster body is sized and configured to protect at least a portion of the cutting element from at least one of erosion or wear during operation of the cutting tool assembly.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

DETAILED DESCRIPTION

Figure 1A:
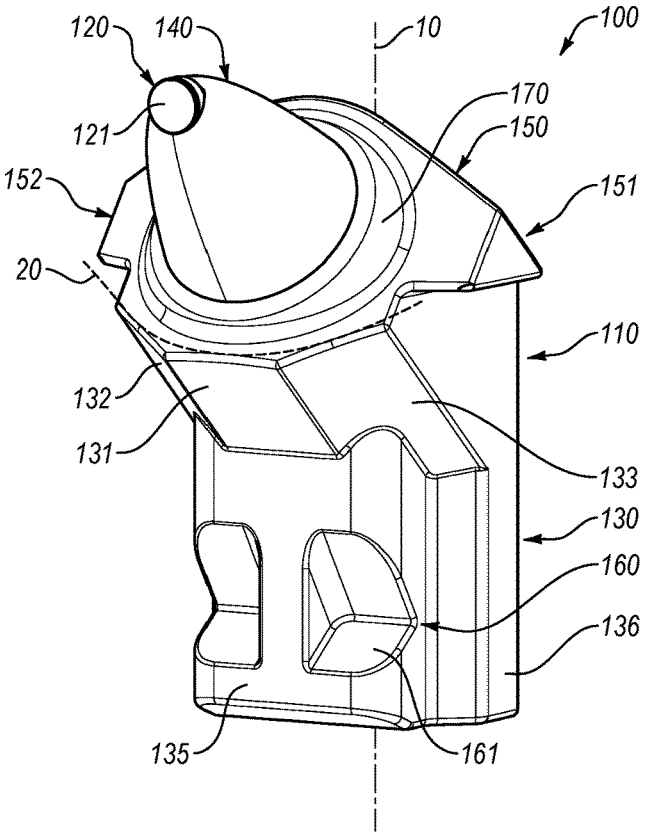
FIG. 1A is a front isometric view of a cutting tool assembly according to an embodiment.

Embodiments of the invention are directed to cutting tool assemblies, cutting tool mounting assemblies, material-removing machines that include cutting tool assemblies and/or cutting tool mounting assemblies, and methods of use and operation thereof. In some embodiments, the various assemblies described herein may be used in material-removing machines that may remove target material, such as a portion or a layer of a pavement. For example, a material-removing machine may include a rotary drum, and the cutting tool assemblies and/or the cutting tool mounting assembly may be mounted to or on the rotary drum. Furthermore, as the material-removing machine rotates the cutting tool assemblies together with the rotary drum, the cutting tool assemblies may engage and cut, grind, or otherwise fail the target material, which may be subsequently removed (e.g., by rotary drum assembly of the material-removing machine).

In an embodiment, the cutting tool assemblies may include one or more superhard working surfaces that may engage the target material. As used herein, "superhard material" includes materials exhibiting a hardness that is at least equal to the hardness of tungsten carbide (i.e., a portion of or the entire working surface may have a hardness that exceeds the hardness of tungsten carbide). In any of the embodiments disclosed herein, the cutting tool assemblies and the cutting elements may include one or more superhard materials, such as polycrystalline diamond, polycrystalline cubic boron nitride, silicon carbide, tungsten carbide, or any combination of the foregoing superhard materials. For example, a cutting element may include a substrate and a superhard material bonded to the substrate, as described in further detail below. The superhard material may form or define the working surface.

The cutting tool assemblies may include a support block. For example, the support block may be sized and configured to be removably secured to and/or within a base body of cutting tool mounting assembly, and the base body may be secured to a rotatable assembly (e.g., a rotary drum body of a rotary drum). In an embodiment, the support block may include an elongated mounting shank that may be at least partially positioned in a recess of base body and may be secured therein, thereby securing the cutting tool assembly to the base of the cutting tool mounting assembly. Moreover, a bolster body may be bonded to or integrated with the elongated mounting shank of the support block. The bolster body and the elongated mounting shank may be configured such that securing the elongated mounting shank in and/or to the base body to position and orient the bolster body at a predetermined angle relative to a radial line extending from a center of rotation of the rotary drum (e.g., when the base body is mounted to the rotary drum). For example, the bolster body may have a streamlined geometry to help reduce drag during cutting operations and, consequently, improve cutting efficiency.

In an embodiment, the working surface may be formed on or secured to the bolster body (e.g., the working surface may be formed on a cutting element that is secured to the bolster body). Generally, the bolster body may have any number of suitable shapes. In some embodiments, the bolster body may be shaped, sized, or otherwise configured in a manner that may reduce wear thereof during operation. Moreover, in one or more embodiments, the bolster body may be configured to protect or shield at least a portion of the cutting element, such as from erosion and/or wear, (e.g., in a manner that extends the useful life of the cutting element and/or extends useful life of the bond or attachment between the cutting element and the bolster body).

Figure 1B:
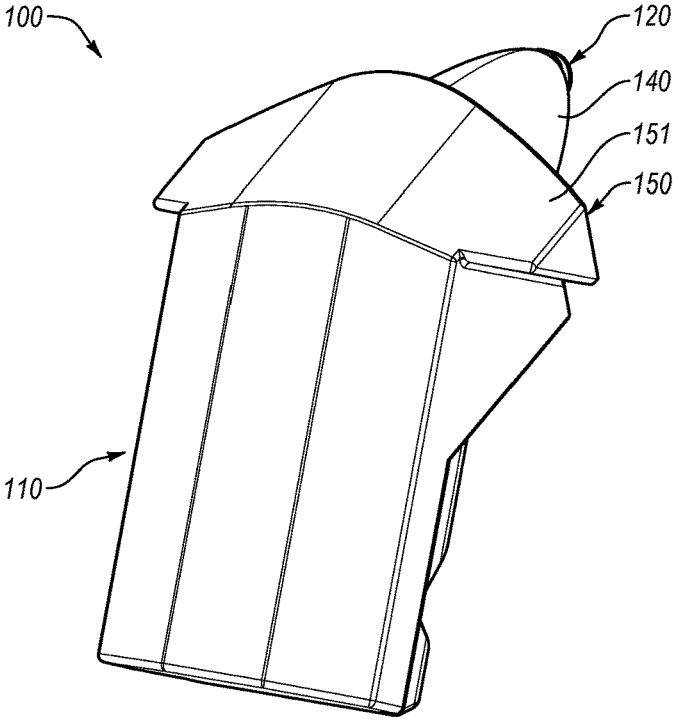
FIG. 1B is a back isometric view of the cutting tool assembly of FIG. 1A.

FIGS. 1A and 1B illustrate front and back isometric views, respectively, of a cutting tool assembly 100 according to an embodiment. For example, as shown in FIG. 1A, the cutting tool assembly 100 includes a support block 110 and a cutting element 120. More specifically, for example, the support block 110 may include an elongated mounting shank 130 and a bolster body 140 that may be secured to or integrated with the elongated mounting shank 130; the cutting element 120 may be secured to or integrated with the bolster body 140 (e.g., the cutting element 120 may be secured with fasteners, welding, brazing, press-fitting, etc., or combination of the foregoing). As described above, the support block 110 maybe sized, shaped, or otherwise configured to be secured at least partially within a base body that may be secured to a rotary drum of a material-removal machine.

As described below in more detail, the cutting element 120 may include a superhard working surface 121. In the illustrated embodiment, the superhard working surface 121 is generally planar. However, the superhard working surface 121 may have any suitable shape and configuration, which may vary from one embodiment to another (e.g., the superhard working surface 121 may be generally domed, generally pointed, or semi-spherical and/or may have a perimeter that may be circular, semi-circular, elliptical, square, or wedge-shaped). The superhard working surface 121 may be sized and configured to engage, cut, scrape, or otherwise cause the target material to fail. For example, the superhard working surface 121 may include a cutting edge that may define at least a portion of the perimeter of the superhard working surface 121. In an embodiment, the superhard working surface 121 may include the cutting edge that may facilitate entry or penetration of the cutting element 120 into the target material and subsequent failing and/or removal thereof.

In some embodiments, the superhard working surface 121 may include a chamfered periphery. In other words, a chamfer may extend from and about at least a portion of the superhard working surface 121 to a peripheral surface of the cutting element 120. As such, the chamfer may form two or more cutting edges (e.g., a cutting edge formed at the interface between the superhard working surface 121 and the chamfer and another cutting edge formed at the interface between the chamfer and the peripheral surface of the cutting element 120).

In some embodiments, the superhard working surface 121 may include superhard material. As used herein, "superhard material" includes a material exhibiting a hardness that is at least equal to the hardness of tungsten carbide (e.g., a portion or the entire working surface may have a hardness that exceeds the hardness of tungsten carbide). In any of the embodiments disclosed herein, the cutting assemblies and the cutting elements may include one or more superhard materials, such as polycrystalline diamond, polycrystalline cubic boron nitride, silicon carbide, tungsten carbide, or any combination of the foregoing superhard materials. For example, a cutting element may include a substrate and a superhard material bonded to the substrate, as described in further detail below.

In some embodiments, the superhard working surface 121 may be formed or defined by a superhard table that may be attached to a substrate. In an embodiment, the substrate may be attached to the bolster body 140. For example, the cutting element 120 (e.g., the substrate thereof) may be recessed in the bolster body 140, such that the bolster body 140 protects or shields the cutting element 120 from wear and/or erosion. Alternatively, the superhard table may be attached directly to the bolster body 140 (e.g., the bolster body 140 may include cemented carbide, and the superhard table that defines the superhard working surface 121 may be bonded directly to the bolster body). That is, the bolster body 140 may form the substrate (e.g., the bolster body 140 may include suitable material for bonding the superhard table thereto, such as tungsten carbide).

In an embodiment, the superhard table may comprise polycrystalline diamond and the substrate may comprise cobalt-cemented tungsten carbide. Furthermore, in any of the embodiments disclosed herein, the polycrystalline diamond table may be leached to at least partially remove or substantially completely remove a metal-solvent catalyst (e.g., cobalt, iron, nickel, or alloys thereof) that was used to initially sinter precursor diamond particles to form the polycrystalline diamond. In another embodiment, an infiltrant used to re-infiltrate a preformed leached polycrystalline diamond table may be leached or may otherwise have a metallic infiltrant removed to a selected depth from a working surface. Moreover, in any of the embodiments disclosed herein, the polycrystalline diamond may be unleached and include a metal-solvent catalyst (e.g., cobalt, iron, nickel, or alloys thereof) that was used to initially sinter the precursor diamond particles that form the polycrystalline diamond and/or an infiltrant used to re-infiltrate a preformed leached polycrystalline diamond table. Examples of methods for fabricating the superhard tables and superhard materials and/or structures from which the superhard tables and elements may be made are disclosed in U.S. Pat. Nos. 7,866,418; 7,998,573; 8,034,136; and 8,236,074; the disclosure of each of the foregoing patents is incorporated herein, in its entirety, by this reference.

The diamond particles that may be used to fabricate the superhard table in a high-pressure/high-temperature process ("HPHT)" may exhibit a larger size and at least one relatively smaller size. As used herein, the phrases "relatively larger" and "relatively smaller" refer to particle sizes (by any suitable method) that differ by at least a factor of two (e.g., 30 μm and 15 μm). According to various embodiments, the diamond particles may include a portion exhibiting a relatively larger size (e.g., 70 μm, 60 μm, 50 μm, 40 μm, 30 μm, 20 μm, 16 μm, 15 μm, 12 μm, 10 μm, 8 μm) and another portion exhibiting at least one relatively smaller size (e.g., 15 μm, 12 μm, 10 μm, 8 μm, 6 μm, 5 μm, 4 μm, 3 μm, 2 μm, 1 μm, 0.5 μm, less than 0.5 μm, 0.1 μm, less than 0.1 μm). In an embodiment, the diamond particles may include a portion exhibiting a relatively larger size between about 10 μm and about 40 μm and another portion exhibiting a relatively smaller size between about 1 μm and 4 μm. In another embodiment, the diamond particles may include a portion exhibiting the relatively larger size between about 15 μm and about 50 μm and another portion exhibiting the relatively smaller size between about 5 μm and about 15 μm. In another embodiment, the relatively larger size diamond particles may have a ratio to the relatively smaller size diamond particles of at least 1.5. In some embodiments, the diamond particles may comprise three or more different sizes (e.g., one relatively larger size and two or more relatively smaller sizes), without limitation. The resulting polycrystalline diamond formed from HPHT sintering the aforementioned diamond particles may also exhibit the same or similar diamond grain size distributions and/or sizes as the aforementioned diamond particle distributions and particle sizes. Additionally, in any of the embodiments disclosed herein, the superhard cutting elements may be free-standing (e.g., substrateless) and/or formed from a polycrystalline diamond body that is at least partially or fully leached to remove a metal-solvent catalyst initially used to sinter the polycrystalline diamond body.

As noted above, the superhard table may be bonded to the substrate. For example, the superhard table comprising polycrystalline diamond may be at least partially leached and bonded to the substrate with an infiltrant exhibiting a selected viscosity, as described in U.S. patent application Ser. No. 13/275,372, entitled "Polycrystalline Diamond Compacts, Related Products, And Methods Of Manufacture," the entire disclosure of which is incorporated herein by this reference. In an embodiment, an at least partially leached polycrystalline diamond table may be fabricated by subjecting a plurality of diamond particles (e.g., diamond particles having an average particle size between 0.5 μm to about 150 μm) to an HPHT sintering process in the presence of a catalyst, such as cobalt, nickel, iron, or an alloy of any of the preceding metals to facilitate intergrowth between the diamond particles and form a polycrystalline diamond table comprising bonded diamond grains defining interstitial regions having the catalyst disposed within at least a portion of the interstitial regions. The as-sintered polycrystalline diamond table may be leached by immersion in or exposure to an acid or subjected to another suitable process to remove at least a portion of the catalyst from the interstitial regions of the polycrystalline diamond table, as described above. The at least partially leached polycrystalline diamond table includes a plurality of interstitial regions that were previously occupied by a catalyst and form a network of at least partially interconnected pores. In an embodiment, the sintered diamond grains of the at least partially leached polycrystalline diamond table may exhibit an average grain size of about 20 μm or less. Subsequent to leaching the polycrystalline diamond table, the at least partially leached polycrystalline diamond table may be bonded to a substrate in an HPHT process via an infiltrant with a selected viscosity. For example, an infiltrant may be selected that exhibits a viscosity that is less than a viscosity typically exhibited by a cobalt cementing constituent of typical cobalt-cemented tungsten carbide substrates (e.g., 8% cobalt-cemented tungsten carbide to 13% cobalt-cemented tungsten carbide).

Additionally or alternatively, the superhard table may be a polycrystalline diamond table that has a thermally-stable region, having at least one low-carbon-solubility material disposed interstitially between bonded diamond grains thereof, as further described in U.S. patent application Ser. No. 13/027,954, entitled "Polycrystalline Diamond Compact Including A Polycrystalline Diamond Table With A Thermally-Stable Region Having At Least One Low-Carbon-Solubility Material And Applications Therefor," the entire disclosure of which is incorporated herein by this reference. The low-carbon-solubility material may exhibit a melting temperature of about 1300° C. or less and a bulk modulus at 20° C. of less than about 150 GPa. The low-carbon-solubility, in combination with the high diamond-to-diamond bond density of the diamond grains, may enable the low-carbon-solubility material to be extruded between the diamond grains and out of the polycrystalline diamond table before causing the polycrystalline diamond table to fail during operations.

In some embodiments, the polycrystalline diamond, which may form the superhard table, may include bonded-together diamond grains having aluminum carbide disposed interstitially between the bonded-together diamond grains, as further described in U.S. patent application Ser. No. 13/100,388, entitled "Polycrystalline Diamond Compact Including A Polycrystalline Diamond Table Containing Aluminum Carbide Therein And Applications Therefor," the entire disclosure of which is incorporated herein by this reference.

In some embodiments, one or more portions and/or surfaces of the support block 110 may be configured to be pressed or forced to at least partially contact corresponding portions and/or surfaces of the base body. For example, pressing one or more surfaces of the support block 110 against corresponding one or more surfaces of the base body may prevent or limit movement of the support block 110 in one or more directions or orientations relative to the base body (e.g., during operation of the cutting tool assembly 100). In the illustrated embodiment, the elongated mounting shank 130 includes an angled surface 131 that may at least partially contact a corresponding angled surface and the base body. In particular, for example, the surface 131 may form an obtuse angle with a vertical axis 10 of the cutting tool assembly 100. For example, the vertical axis 10 may be generally parallel to a vertical portion of the elongated mounting shank 130 (e.g., parallel to peripheral surfaces 135, 136 of the elongated mounting shank 130).

Furthermore, the support block 110 may include multiple angled surfaces that may be oriented at various angles relative to the vertical axis 10. For example, the surface 131 may extend between angled surfaces 132, 133, which may be positioned along each side of surface 131 (e.g., the surfaces 132 and/or 133 may be at a different angle relative to the vertical axis than surface 131). In an embodiment, the surface 131 may be generally planar. Similarly, the surfaces 132 and/or 133 may be generally planar. As shown in the illustrated embodiment, the surfaces 131, 132, 133 may be arranged along a generally arcuate path, such as along an imaginary arcuate path 20 (e.g., the surfaces 131, 132, 133 may be generally tangent to the arcuate path 20). For example, as described below in more detail, when the elongated mounting shank 130 is positioned in the base body, and the surfaces 131, 132, 133 may abut or press against corresponding surfaces of the base body, the surfaces 131, 132, 133 may prevent or limit movement of the cutting tool assembly 100 relative to the base body (e.g., in directions generally outward from the surfaces 131, 132, 133) and may prevent or limit pivoting or twisting of the cutting tool assembly 100 relative to the base body (e.g., about the vertical axis 10).

Generally, the vertical portion of the elongated mounting shank 130 may have any suitable peripheral shape that may be defined by one or more peripheral surfaces and may vary from one embodiment to the next. In the illustrated embodiment, the peripheral surfaces defining the vertical portion of the elongated mounting shank 130 may include one or more planar surfaces, such as surfaces 135 and 136 (e.g., surface 135 may be oriented at approximately 90° angle relative to surface 136, and surfaces 135, 136 may be generally parallel to the vertical axis 10). For example, planar surfaces defining the vertical portion of the elongated mounting shank 130 may correspond to and/or abut or at least partially contact corresponding surfaces of the base body in a manner that prevents or limits rotation or pivoting of the cutting tool assembly 100 about the vertical axis 10.

As described above, the bolster body 140 may be secured (e.g., by welding, brazing, soldering, laser fusing, press-fitting, mechanically attaching, combinations of the foregoing, etc.) to the support block 110 (e.g., to the elongated mounting shank 130). In some embodiments, the bolster body 140 may be oriented at a non-parallel and/or non-perpendicular angle relative to the elongated mounting shank 130. For example, the bolster body 140 and the elongated mounting shank 130 may form or define an obtuse angle therebetween.

In some embodiments, the bolster body 140 may be bonded to the elongated mounting shank 130 (e.g., the bolster body 140 may be bonded to the elongated mounting shank 130 by brazing, welding, press-fitting, mechanically attaching, combinations of the foregoing, etc.). Alternatively, the elongated mounting shank 130 and bolster body 140 may be integral or integrated together (e.g., the bolster body 140 and elongated mounting shank 130 may be formed or fabricated from a single piece of material). In some embodiments, the bolster body 140 and elongated mounting shank 130 may include different materials from each other. For example, the bolster body 140 may include a material that is stronger (e.g., exhibiting a higher yield strength) and/or more abrasion resistant than the material of the elongated mounting shank 130). In at least one embodiment, the bolster body 140 may include a material such as carbide and/or cemented carbide (e.g., the bolster body 140 may include any number of carbide materials and/or cementing alloys, which may be similar to or the same as the carbides described herein in connection with the substrate of the cutting element 120) and the elongated mounting shank 130 may include steel, and the bolster body 140 may be brazed to the elongated mounting shank 130. Additionally or alternatively, the bolster body 140 may include any suitable steel (e.g., carbon steel, stainless steel, or tool steel), which may be heat treated to a suitable hardness. For example, a steel bolster body 140 may be welded to the elongated mounting shank 130.

The support block 110 may include an upper portion 150, and the bolster body 140 may be secured to or integrated with the upper portion 150 and may extend outward therefrom. In some embodiments, the upper portion 150 may have a greater peripheral size (e.g., may be wider and/or longer) that the elongated mounting shank 130. For example, the upper portion 150 may include one or more shoulder portions or shoulders, such as shoulders 151, 152 that extend beyond the elongated mounting shank 130 (e.g., one or more surfaces of the shoulders 151, 152 may extend beyond one or more surfaces of the elongated mounting shank 130 and may optionally extend generally perpendicularly therefrom). For example, the shoulders 151 and/or 152 may at least partially contact one or more corresponding portions or surfaces of the base block (e.g., the shoulders 151 and/or 152 may vertically position the cutting tool assembly 100 relative to the base block). Under some operating conditions, as the cutting element 120 engages and/or enters the target material, the cutting tool assembly 100 may experience one or more forces thereon, which may urge movement of the cutting tool assembly 100 relative to the base body.

In some embodiments, however, the cutting tool assembly 100 may be fixedly secured (e.g., by metallurgical attachment, such as brazing, soldering, welding, etc., by mechanical attachment (e.g., bolts and/or clamps), such as by press-fitting, fastening, etc., or combinations of the foregoing, etc.) to the base body in a manner that limits or prevents movement that may otherwise result during operation of the cutting tool assembly 100. For example, the shoulders 151 and/or 152 may at least partially counteract or oppose the forces experience by the cutting tool assembly 100 during operation (e.g., as the shoulders 151 and/or 152 press against corresponding portions and/or surfaces of the base body). Additionally or alternatively, as mentioned above, the shape and/or size of the elongated mounting shank 130 (e.g., the shape and/or size of the vertical portion of the elongated mounting shank 130, the surfaces 131, 132, 133 of the elongated mounting shank 130, etc.) may prevent or limit movement of the cutting tool assembly 100 relative to the base body (e.g., from the forces experienced by the cutting tool assembly 100 during operation).

In some embodiments, the elongated mounting shank 130 may be secured to and/or positioned at least partially within the corresponding recess in the base body by one or more fasteners. For example, the elongated mounting shank 130 may include one or more locations that may accept or facilitate one or more corresponding fasteners that may secure or fasten the cutting tool assembly 100 to the base body. In the illustrated embodiment, the elongated mounting shank 130 includes fastener recesses 160. In particular, for example, the recesses 160 may include at least one surface against which a fastener may press or contact, thereby positioning the elongated mounting shank 130 at least partially into the recess in the base body. In an embodiment, the recesses 160 may include corresponding surfaces 161 (e.g., the surfaces 161 may be generally perpendicular to the surface 131). In any event, contact between a leading face of a fastener and one or more surfaces 161 of the recesses 160 may retain the elongated mounting shank 130 in the base body, thereby securing the cutting tool assembly at least partially within and/or to the base body in a manner that prevents or limits movement of the cutting tool assembly 100 relative to the base body during operation.

As described below in more detail, the bolster body 140 may be generally shaped to reduce drag as the cutting tool assembly 100, together with the bolster body 140, advances into the target material. In an embodiment, the bolster body 140 may be shaped such that the failed material may move away from the cutting element 120. For example, the bolster body 140 may have a generally tapered shape (e.g., a generally conical shape or frusto-conical shape). Moreover, the elongated mounting shank 130 may include a transition region 170, which may provide or form a transition between the bolster body 140 and the upper portion 150. For example, the transition region may extend between the bolster body 140 and an upper surface of the upper portion 150.

In some embodiments, the transition region 170 may be shaped, sized, and otherwise configured to guide or direct the flow or movement of the failed material past the bolster body 140 and along or over the upper portion 150 of the support block 110. For example, the transition region 170 may be generally tapered, such that the smaller portion of the taper is near the bolster body 140 and the larger portion of the taper is near the upper portion 150. In at least one embodiment, at least a portion of the upper portion 150 may be shaped to deflect or channel the failed material away from the support block 110 during operation. As shown in FIG. 1B, for example, an upper surface 151 of the upper portion 150 may be generally arcuate or may otherwise slant downward and away from an uppermost point of the upper portion 150.

In an embodiment, the support block 110 may be generally solid or monolithic. Alternatively, the support block 110 may include one or more cutouts or recesses, such as in a back side thereof (e.g., in a side facing away from the direction of movement or cut of the cutting tool assembly 100 during operation). For example, the recess(es) may facilitate or allow channeling movement or flow of failed material away from the cutting tool assembly 100.

Figure 2:
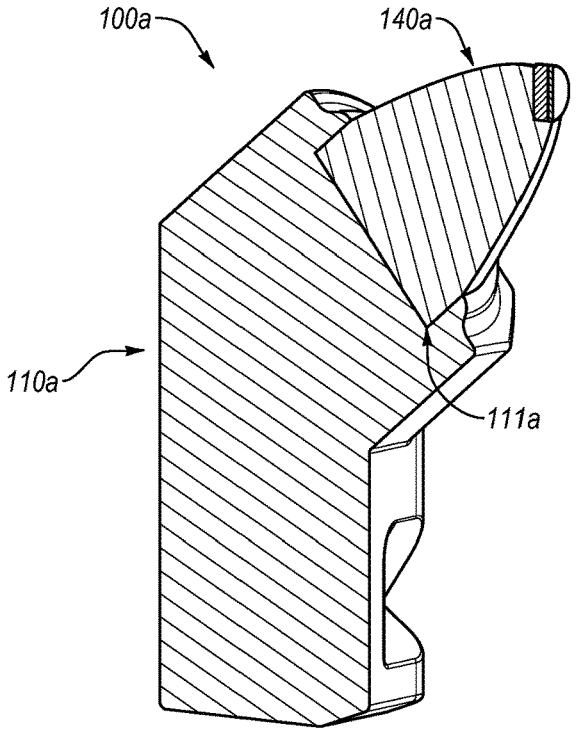
FIG. 2 is a cross-sectional view of the cutting tool assembly of FIG. 1A.

As mentioned above, the bolster body 140 may be incorporated with or bonded to the support block 110. FIG. 2 illustrates a cutting tool assembly 100*a* that includes a bolster body 140*a* bonded to a support block 110*a*, according to an embodiment. Except as otherwise described herein, the cutting tool assembly 100*a* and its materials, features, elements, or components may be similar to or the same as cutting tool assembly 100 (FIGS. 1A-1B) and its respective materials, features, elements and components. For example, the support block 110*a* may include a cutting element 120 that may be similar to or the same as the cutting element 120 of the cutting tool assembly 100 (FIGS. 1A-1B).

In an embodiment, the support block 110*a* may include a recess 111*a* for locating the bolster body 140*a* relative to the support block 110*a*. In some embodiments, the recess 111*a* may have a generally circular perimeter (e.g., the recess 111*a* may be cylindrical). Alternatively, the perimeter of recess 111*a* may have at least partially non-circular shape, which may facilitate orienting the bolster body 140*a* relative to the support block 110*a*. In any event, in at least one embodiment, the bolster body 140*a* may be positioned in the recess 111*a* and may be bonded (e.g., brazed, welded, etc.) to at least a portion of a wall defining the recess 111*a* and/or to the support block 110*a*.

Figure 3:
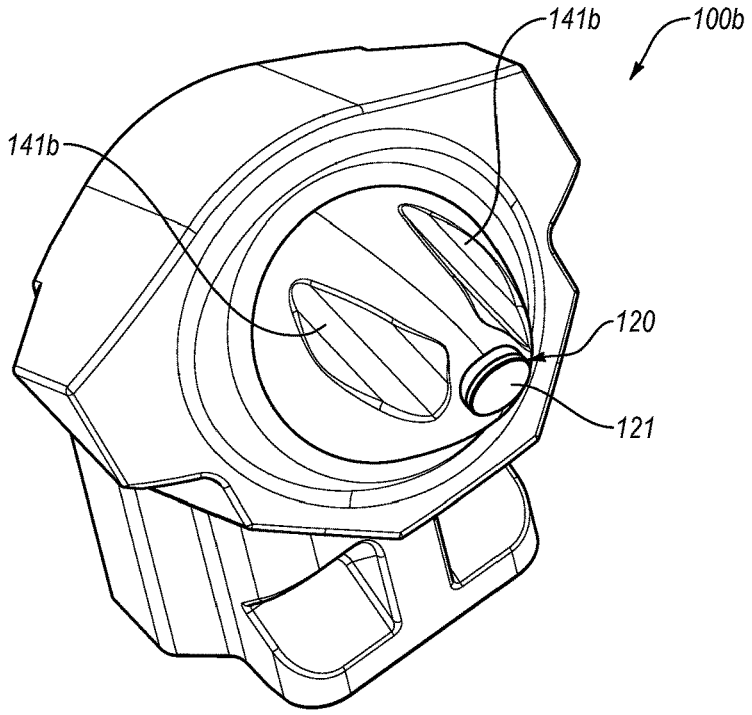
FIG. 3 is an isometric view of a cutting tool assembly according to an embodiment.

As described above, the bolster body may be generally shaped to reduce or minimize or limit drag during operation of the cutting tool assembly, as the cutting tool assembly moves through the target material. In some embodiments, the bolster body may include one or more drag-reduction features that may reduce drag of the bolster body (e.g., as compared with a bolster body without such features), which may extend the useful life of the cutting tool assembly. FIG. 3 illustrates an isometric view of a cutting tool assembly 100*b* that has a bolster body 140*b* with drag-reduction features, according to an embodiment. Except as otherwise described herein, the cutting tool assembly 100*b* and its materials, features, elements, or components may be similar to or the same as any of the cutting tool assemblies cutting tool assemblies 100, 100*a* (FIGS. 1A-2) and their respective materials, features, elements and components. For example, the cutting tool assembly 100*b* may include a support block

110*b* and a bolster body 140*b* bonded together or integrated with each other, and the support block 110*b* may be similar to or the same as the support block 110 (FIGS. 1A-1B). It should be appreciated that, as noted above, the same or similar reference numbers (e.g., the same base reference numbers with different letter modifiers, such as support blocks 110 and 110*a* (FIGS. 1A-2), may comprise the same or similar material and/or may include one, some, or all of the same features and/or elements.

In an embodiment, the bolster body 140*b* may include notches 141*b* that may extend from a forward facing portion of the bolster body 140*b* (e.g., portion facing generally in the same direction as the superhard working surface 121 of the cutting element 120) and to the backward facing portion of the bolster body 140*b* (e.g., portion facing away from the superhard working surface 121 of the cutting element 120). As described above, during operation, as the bolster body 140*b* of the cutting tool assembly 100*b* enters the target material, the cutting element 120 may fail the target material. For example, at least some of failed material may flow or move away from the superhard working surface 121 of the cutting element 120 and through one or more notches 141*b*. In some embodiments, the notches 141*b* may facilitate movement of the failed material away from the superhard working surface 121, thereby extending useful life thereof. Furthermore, for example, the bolster body 140*b* that includes the notches 141*b* may be generate less drag through the target material and thereby may require less energy during operation thereof (as compared with a bolster body that does not include the notches).

Figure 4:
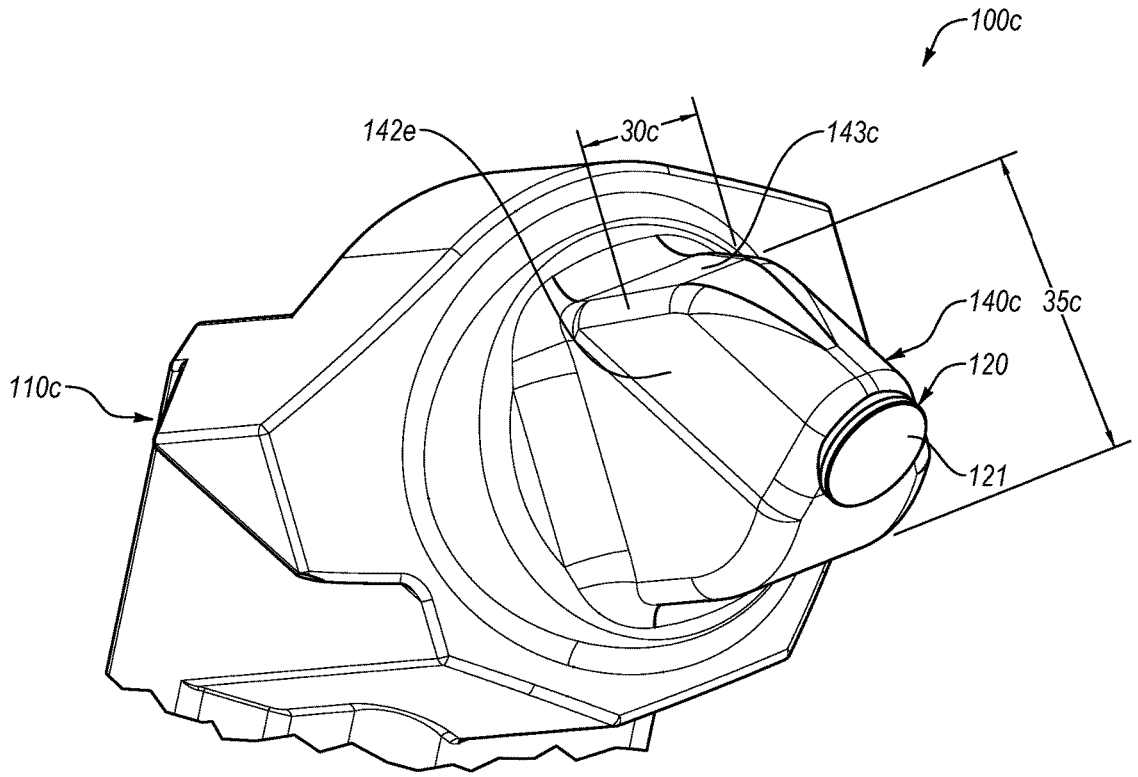
FIG. 4 is a partial isometric view of a cutting tool assembly according to another embodiment.

In some embodiments, the bolster body may have a generally narrow profile, which may facilitate reduced drag as the cutting tool assembly moves through the target material (as compared with a cutting tool that includes a relatively wider bolster body). FIG. 4 illustrates an isometric view of a cutting tool assembly 100*c* that includes a narrow bolster body 140*c*, according to an embodiment. Except as otherwise described herein, the cutting tool assembly 100*c* and its materials, features, elements, or components may be similar to or the same as any of the cutting tool assemblies 100, 100*a*, 100*b* (FIGS. 1A-3) and their respective materials, features, elements and components. For example, the cutting tool assembly 100*c* may include a support block 110*c* and a bolster body 140*c* bonded together or integrated with each other, and the support block 110*c* may be similar to or the same as the support block 110 (FIGS. 1A-1B).

In an embodiment, the bolster body 140*c* may be generally narrow to reduce drag thereof in the target material (e.g., as compared with wider bolster bodies). More specifically, for example, the cutting element 120 may be mounted to the bolster body 140*c*, and the bolster body 140*c* may have a first dimension, such as width 30*c*, that may be similar to or the same as a dimensions of the cutting element 120, such as the width or diameter of the cutting element 120 (e.g., as measure along an imaginary line that is generally perpendicular to the direction of cut during operation of the cutting tool assembly 100*c*). For example, the width 30*c* of the bolster body 140*c* may be smaller than a length 35*c* thereof. In an embodiment, the width 30*c* of the bolster body 140*c* may be less than 2 times the diameter of the cutting element 120 or less than 3× the diameter of the cutting element 120 (e.g., the width 30*c* may be a multiple of the diameter of the cutting element 120, which may be in one or more of the following ranges: about 1.01-1.1 times the diameter of the cutting element 120; about 1.09-1.3 times the diameter of the cutting element 120; about 1.1-1.5 times the diameter of the cutting element 120; or about 1.4-1.9 times the diameter of the cutting element 120). Hence, in an embodiment, the width 30*c* of the bolster body 140*c* may be suitably narrow (e.g., relative to the support block 110), such as to reduce resistance or contact between the bolster body 140*c* and the target material engaged by the cutting tool assembly 100*c*.

Furthermore, in some embodiments, the bolster body 140*c* may include one or more generally planar surfaces, such as surfaces 142*c*, 143*c*. In an embodiments, the width 30*c* of the bolster body 140*c* may be defined by generally planar surfaces, such as the surface 142*c* and a surface opposite thereto, which may be similar to or the same as the surface 142*c*. In at least one embodiment, the leading face of the bolster body 140*c* (e.g., a face of the bolster body 140*c* that generally faces in the direction of cut or movement of the cutting tool assembly 100*c* during operation) and/or the trailing face thereof (e.g., a face of the bolster body 140*c* that generally faces away from the direction of cut or movement of the cutting tool assembly 100*c* during operation) may be defined by one or more generally planar surfaces. For example, the trailing face of the bolster body 140*c* may be at least partially defined by the surface 143*c*.

Figure 5:
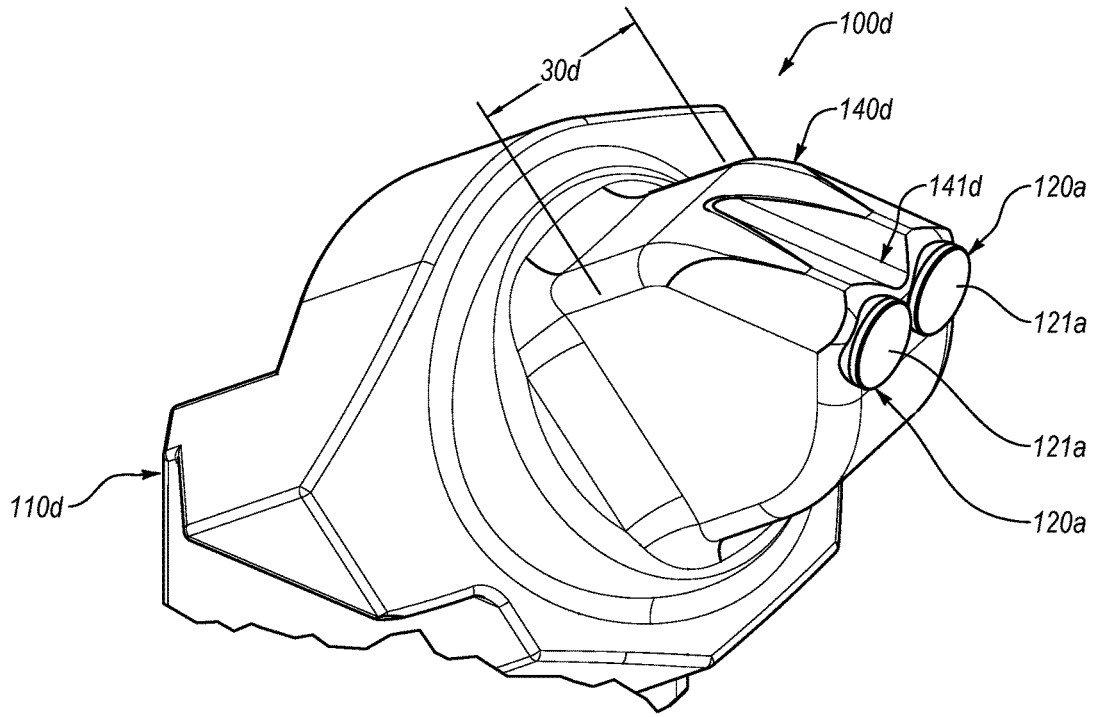
FIG. 5 is a partial isometric view of a cutting tool assembly according to yet another embodiment.

Any of the cutting tool assemblies described herein may include any number of cutting elements, which may vary from one embodiment to the next. FIG. 5 illustrates a cutting tool assembly 100*d* that includes two cutting element 120*a*, according to an embodiment. Except as otherwise described herein, the cutting tool assembly 100*d* and its materials, features, elements, or components may be similar to or the same as any of the cutting tool assemblies 100, 100*a*, 100*b*, 100*c* (FIGS. 1A-4) and their respective materials, features, elements and components. For example, the cutting tool assembly 100*d* may include a support block 110*d* and a bolster body 140*d* bonded together or integrated with each other, and the support block 110*d* may be similar to or the same as the support block 110 (FIGS. 1A-1B).

In an embodiment, the cutting elements 120*a* may be positioned near each other and/or may abut each other. For example, the cutting elements 120*a* may be aligned generally along a width 30*d* of the bolster body 140*d*. Alternatively or additionally, the cutting elements 120*a* may be positioned near each other and at a predetermined height (e.g., as measured downward from an uppermost portion of the bolster body 140*d*.

As described above, the bolster body 140*d* may include one or more notches that (for example) may facilitate movement or flow of failed material away from superhard working surfaces 121*a* of the cutting elements 120*a*. In some embodiments, the bolster body 140*d* may include a notch 141*d* that may extend between the cutting elements 120*a*. For example, at least some of the failed material may move away from the superhard working surface 121*a* of the cutting elements 120*a* and into the notch 141*d* of the bolster body 140*d*, which may extend useful life of the cutting elements 120*a*.

Figure 6:
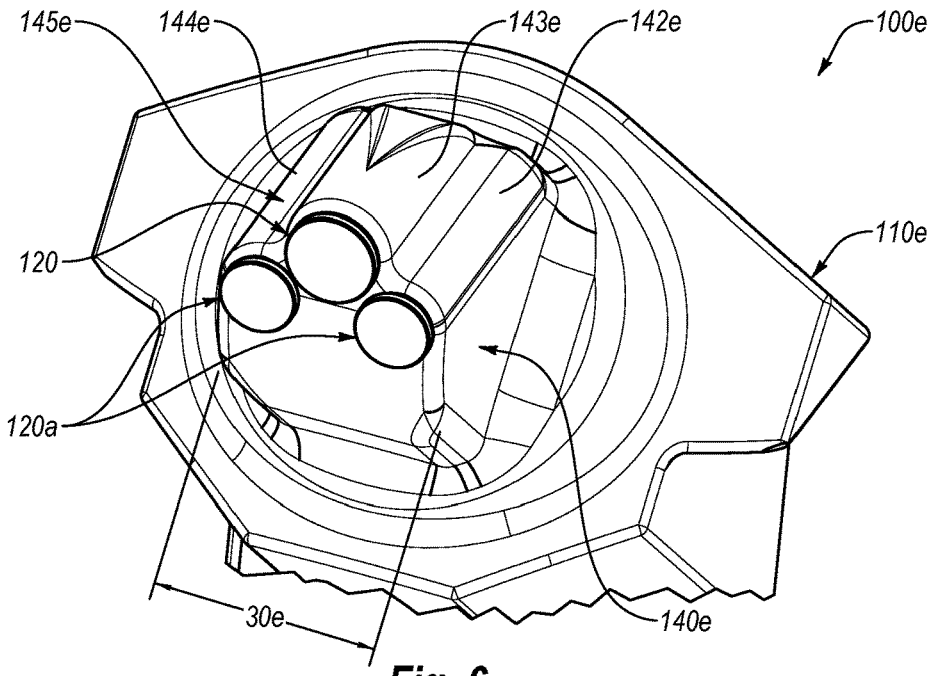
FIG. 6 is a partial isometric view of a cutting tool assembly according to still one other embodiment.

FIG. 6 illustrates an isometric view of a cutting tool assembly 100*e* that includes three cutting elements, according to an embodiment. Except as otherwise described herein, the cutting tool assembly 100*e* and its materials, features, elements, or components may be similar to or the same as any of the cutting tool assemblies 100, 100*a*, 100*b*, 100*c*, 100*d* (FIGS. 1A-5) and their respective materials, features, elements and components. For example, the cutting tool assembly 100*e* may include a support block 110*e* and a bolster body 140*e* bonded together or integrated with each other, and the support block 110*e* may be similar to or the same as the support block 110 (FIGS. 1A-1B).

In an embodiment, the cutting tool assembly 100*e* may include two cutting elements 120*a* and one cutting element 120 (e.g., the cutting element 120 may be positioned at least partially between the cutting elements 120*a*). For example, the corresponding ones of the cutting elements 120*a* may and the cutting element 120 may be positioned at different apexes of an imaginary triangle (e.g., the imaginary triangle may be an equilateral triangle with the base thereof oriented generally parallel to a width 30*e* of the bolster body 140*e*). In some embodiments, the cutting element 120 may be positioned at or near an upper apex and near an uppermost portion of the bolster body 140, and the cutting elements 120*a* may be positioned at or near lower apexes of the imaginary triangle and along a base thereof.

The bolster body 140*e* may be generally sized, shaped, and otherwise configured to accommodate the cutting elements 120, 120*a* at suitable positions or locations. For example, the bolster body 140*e* may have an upper portion 145*e* supporting the cutting elements 120, 120*a*, such that the upper portion 145*e* is at least in part defined by rounded surfaces 142*e*, 143*e*, 144*e*, which may generally follow the contour of corresponding ones of the cutting elements 120*a*, 120. In some embodiments, a bolster body 140*e* may have a reduced drag through the target material (e.g., as compared with the bolster body that includes more material between the outer surface thereof and the cutting elements 120*a* and/or 120).

Figure 7:
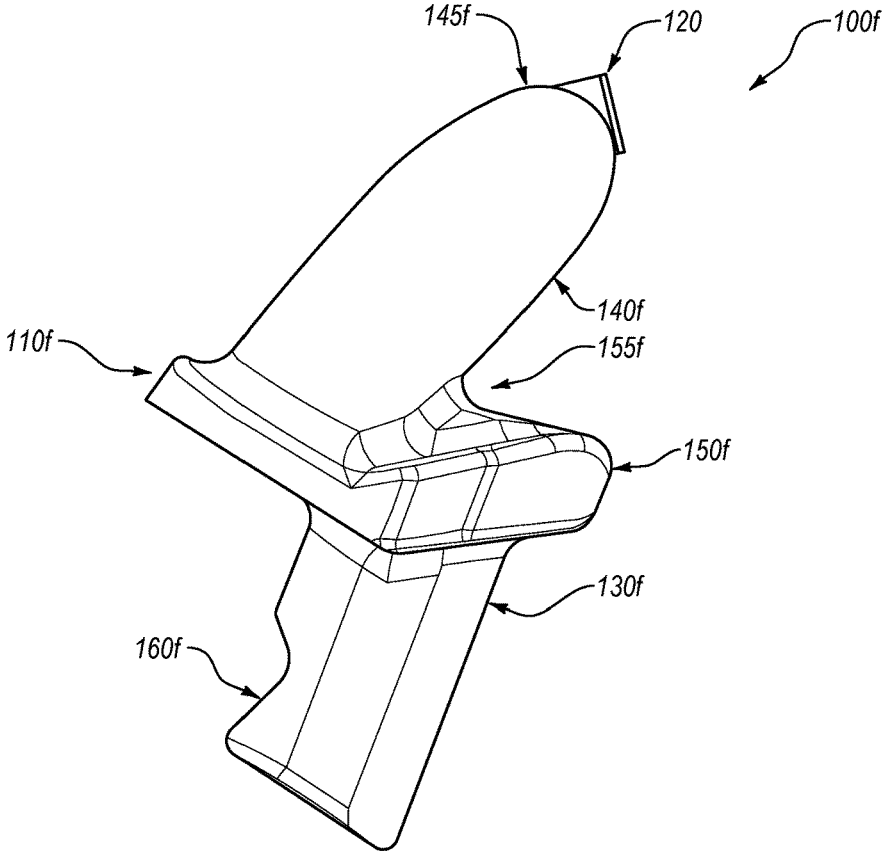
FIG. 7 is a side view of a cutting tool assembly according to an embodiment.

As described above, the bolster body may have any number of suitable shapes and/or sizes and may be integrated with the support block. FIG. 7 illustrates a side view of a cutting tool assembly 100*f* according to an embodiment. Except as otherwise described herein, the cutting tool assembly 100*f* and its materials, features, elements, or components may be similar to or the same as any of the cutting tool assemblies 100, 100*a*, 100*b*, 100*c*, 100*d*, 100*e* (FIGS. 1A-6) and their respective materials, features, elements and components. For example, as mentioned above, the cutting tool assembly 100*f* may include a support block 110*f* and bolster body 140*f* incorporated together (e.g., the support block 110*f* and the bolster body 140*f* may be integrally formed, such as fabricated from a single piece of material).

The support block 110*f* may include an elongated mounting shank 130*f* at least portion of which may be inserted into and/or secured to a base body (e.g., the elongated mounting shank 130*f* may include at least one recess 160*f* that may accept a portion of a fastener that may contact and/or restrict movement of the elongated mounting shank 130*f*, thereby securing the elongated mounting shank 130*f* in a recess of the base body). As described above, the support block 110*f* may include a upper portion 150*f* that may be attached to or integrated with the elongated mounting shank 130*f* (e.g., the upper portion 150*f* may facilitate positioning and/or securing of the support block 110*f* relative to the base body). Moreover, the bolster body 140*f* may extend from and/or may be integrated with the upper portion 150*f*.

In an embodiment, the bolster body 140*f* may have a generally cylindrical shape and a rounded upper portion 145*f* (e.g., a cutting element 120 may be attached to the bolster body 140*f* at or near the upper portion 145*f* thereof). In an embodiment, the cutting tool assembly 100*s* may include a transition region 155*f* (e.g., bend, notch, fillet, or chamfer) between the bolster body 140*f* and the upper portion 150*f*. For example, the transition region 155*f* may facilitate flow or movement failed material away from a leading portion of the cutting tool assembly 100*f* (e.g., away from a portion of the cutting tool assembly 100*f* that faces toward the cutting direction of the cutting tool assembly 100*f* during operation).

Figure 8:
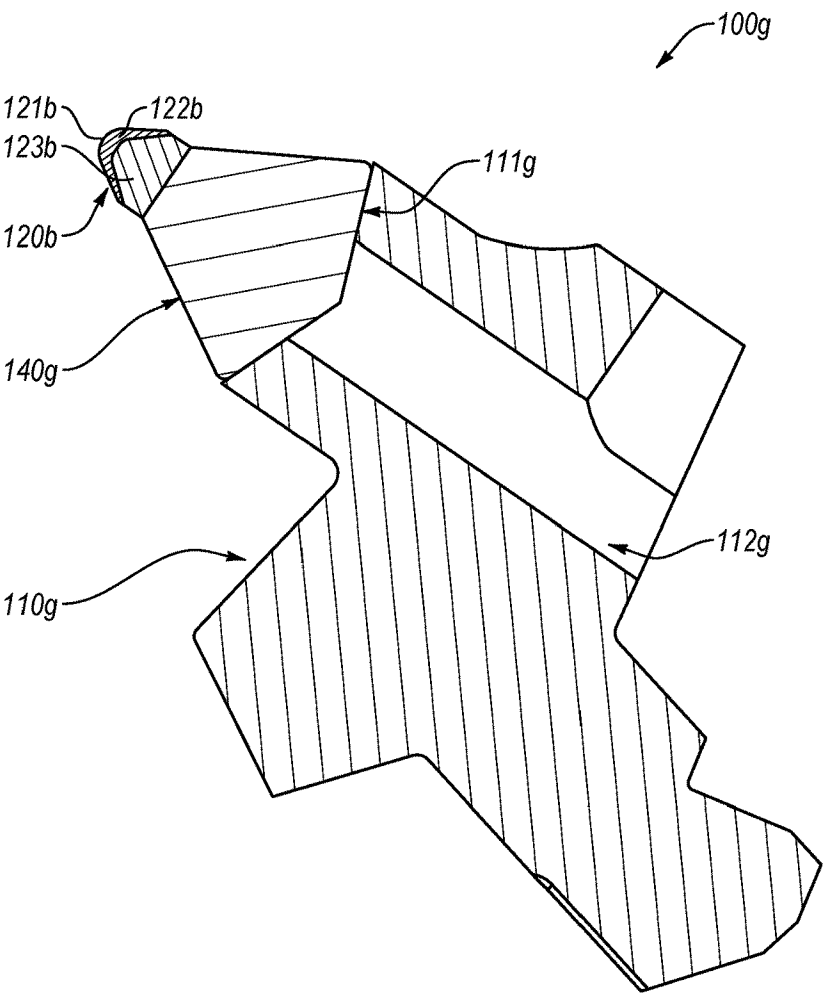
FIG. 8 is a cross-sectional view of a cutting tool assembly according to an embodiment.

As mentioned above, the bolster body may be bonded to the support block of the cutting tool assembly. FIG. 8 illustrates a cross-sectional view of a cutting tool assembly 100*g* that includes a bolster body 140*g* bonded to a support block 110*g*, according to an embodiment. For example, the bolster body 140*g* may be brazed, welded, or otherwise metallurgically bonded to the support block 110*g* (e.g., along interface surface 111*g*). Except as otherwise described herein, the cutting tool assembly 100*g* and its materials, features, elements, or components may be similar to or the same as any of the cutting tool assemblies 100, 100*a*, 100*b*, 100*c*, 100*d*, 100*e*, 100*f* (FIGS. 1A-7) and their respective materials, features, elements and components. For example, as mentioned above, the cutting tool assembly 100*g* may include a support block 110*g* and bolster body 140*g* bonded together. The support block 110*g* may be similar to the any of the support blocks 110, 110*a*, 110*b*, 110*c*, 110*d*, 110*e*, or 110*f* (FIGS. 1A-7), as discussed above. Moreover, the bolster body 140*g* may be similar to any of bolster bodies 140*a*, 140*b*, 140*c*, 140*d*, 140*e*, or 140*f* (FIGS. 1A-7). It should be also appreciated that, while any of the bolster bodies described herein, such as the bolster body 140*g*, may include or comprise hard (e.g., superhard) or hardened material, additionally or alternatively, any of the bolster bodies may include coating, hardfacing, protective or wear plate, combinations thereof, etc. Also, the bolster bodies, the support block, and wear-resistant shields (e.g., a protective coating, hardfacing, or protective or wear plate) may have one or more of any number of suitable shapes, sizes, or materials, such as described in more detail in U.S. Patent Application No. 62/030,525; Ser. No. 14/266,437; and Ser. No. 14/275,574, the disclosure of each of the foregoing applications is incorporated herein, in its entirety, by this reference.

In some embodiments, the bolster body 140*g* may be bonded to the support block 110*g* along an angled or interface surface 111*g*. For example, the interface surface 111*g* may position and/or orient the bolster body 140*g* relative to the support block 110*g* at a predetermined position and orientation. In an embodiment, the support block 110*g* may include an opening or recess 112*g*. For example, the recess 112*g* may facilitate securing the bolster body 140*g* to the support block 110*g* with a fastener.

Also, as mentioned above, the particular shape and/or size of cutting element(s) included in the cutting tool assembly may vary from one environment to the next. In the illustrated embodiment, the cutting tool assembly 100*g* includes a generally convex cutting element 120*b* (e.g., at least partially domed, pointed, ovoid, conical, or rounded). In particular, the cutting element 120*b* may include a generally convex superhard working surface 121*b*, which may be defined by a superhard table 122*b* bonded to a substrate 123*b*. Moreover, the cutting element 120*b* may be bonded to and may extend beyond the bolster body 140*g* in a manner that facilitates engagement of the superhard working surface 121*b* with the target material during operation of the cutting tool assembly 100*g*.

Figure 9:
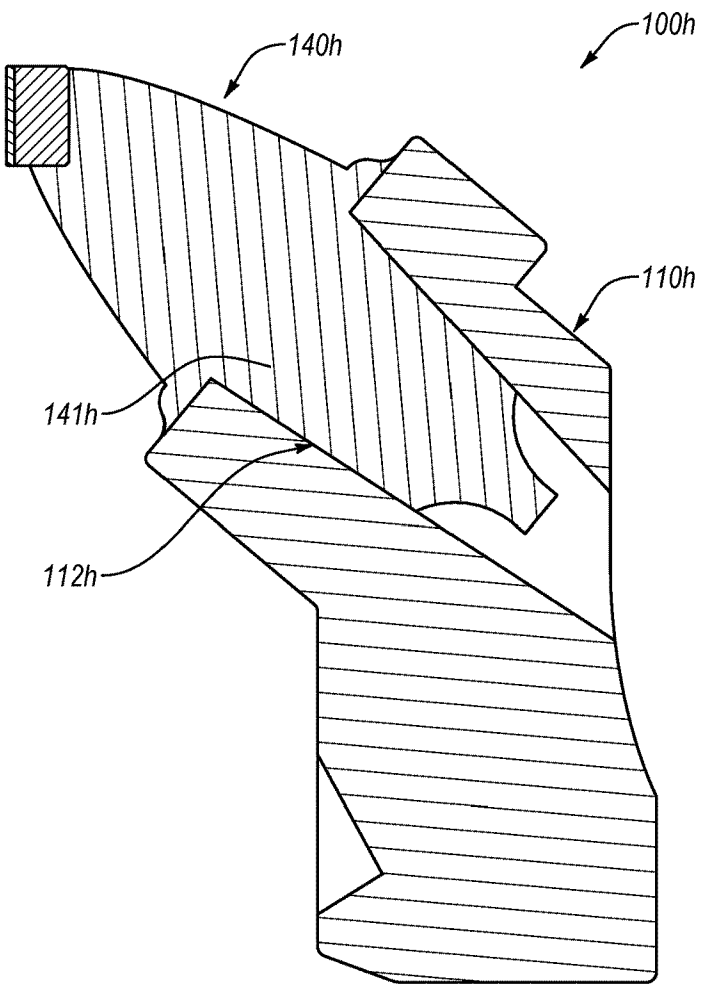
FIG. 9 is a cross-sectional view of a cutting tool assembly according to another embodiment.

Alternatively or additionally, a bolster body may be mechanically secured to support block (e.g., with fastener(s), press-fitting, fitted at a locking angle, etc.). FIG. 9 illustrates a cross-sectional view of a cutting tool assembly 100*h* that includes a bolster body 140*h* mechanically secured to the support block 110*h*, according to an embodiment. Except as otherwise described herein, the cutting tool assembly 100*h* and its materials, features, elements, or components may be similar to or the same as any of the cutting tool assemblies 100, 100*a*, 100*b*, 100*c*, 100*d*, 100*e*, 100*f*, 100*g* (FIGS. 1A-8) and their respective materials, features, elements and components. For example, as mentioned above, the cutting tool assembly 100*h* may include a support block 110*h* and bolster body 140*h* secured together, and the support block 110*h* may be similar to or the same as any of the support blocks 110, 100*a*, 100*b*, 110*c*, 110*d*, 110*e*, 110*f*, or 110*g* (FIGS. 1A-8), as described above.

In the illustrated embodiment, the support block 110*h* includes a recess 112*h*, and the bolster body 140*h* includes a shank 141*h* that may fit into the recess 112*h* and may be secured therein, thereby securing the bolster body 140*h* to the support block 110*h*. For example, the recess 112*h* may have a tapered configuration, and the shank 141*h* may have a generally corresponding or complementary taper, which may secure or lock the shank 141*h* in the recess 112*h* (e.g., the taper of the recess 112*h* and 114*h* may have a locking angle and/or may be a machine taper, such as Morse taper). Under some operating conditions, the bolster body 140*h* may be detached and/or removed from the support block 110*h* (e.g., for servicing and/or replacement). For example, the recess 112*h* may extend through the support block 110*h*, such that the shank 141*h* may be accessed from a back side of the support block 110*h* (e.g., access from the backside of the support block 110*h* may facilitate forcing the shank 141*h* out of the recess 112*h*). Moreover, in an embodiment, the shank 141*h* may be integrated with the bolster body 140*h*. In an embodiment, the shank 141*h* may be attached or secured to the bolster body 140*h* (e.g., the shank may be welded, brazed, soldered, or otherwise metallurgically attached to the bolster body 140*h* and/or may be fastened to the bolster body 140*h*).

Figure 10:
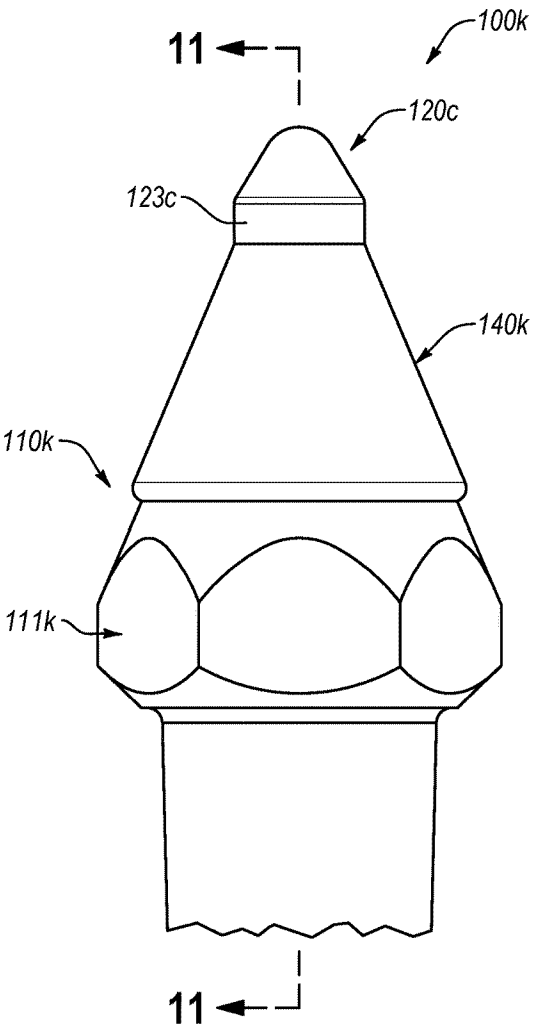
FIG. 10 is a partial side view of a cutting tool assembly according to an embodiment.

The particular configuration of the cutting element may vary from one embodiment to the next. FIG. 10 is a partial side view of a cutting tool assembly 100*k* that includes a generally convex cutting element 120*c*, according to an embodiment. Except as otherwise described herein, the cutting tool assembly 100*k* and its materials, features, elements, or components may be similar to or the same as any of the cutting tool assemblies 100, 100*a*, 100*b*, 100*c*, 100*d*, 100*e*, 100*f*, 100*g*, 100*h* (FIGS. 1A-9) and their respective materials, features, elements and components.

In at least one embodiment, the cutting tool assembly 100*k* may be fastened to the base body. For example, a portion of a support block 110*k* may include one or more features that may accommodate a tool for fastening the support block to the base body (e.g., a wrench, etc.). In an embodiment, a lower portion 111*k* of the support block 110*k* may be configured to accept a wrench (e.g., the lower portion 111*k* of the support block 110*k* may have one or more flats, may have a generally hexagonal or square shape, etc.).

Figure 11:
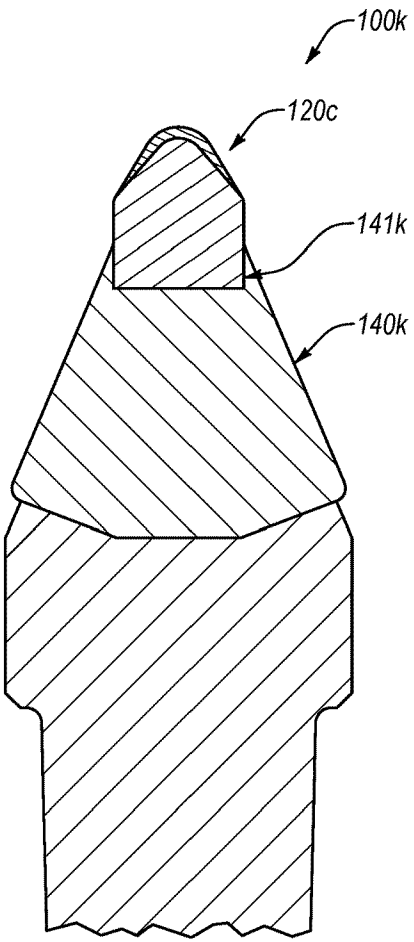
FIG. 11 is a partial cross-sectional view of the cutting tool assembly FIG. 10.

In at least one embodiment the cutting element 120*c* may be bonded to a bolster body 140*k* of the cutting tool assembly 100*k*. In some embodiments, a substrate 123*c* of the cutting element 120*c* may be at least partially exposed out of and/or extend beyond the bolster body 140*k* of the cutting tool assembly 100*k*. As shown in FIG. 11, for example, the bolster body 140*k* may include a pocket or recess 141*k* that may accommodate the cutting element 120*c* (e.g., the substrate 123*c* of the cutting element 120*c*). As described above, the cutting element 120*c* may be brazed, press-fit, fastened, or otherwise secured to the bolster body 140*k*. For example, the recess 141*k* may be sized and shaped in a manner that facilitates brazing, press-fitting, or otherwise securing the cutting element 120*c* to the bolster body 140*k* (e.g., the recess 141*k* may be generally cylindrical).

Figure 12:
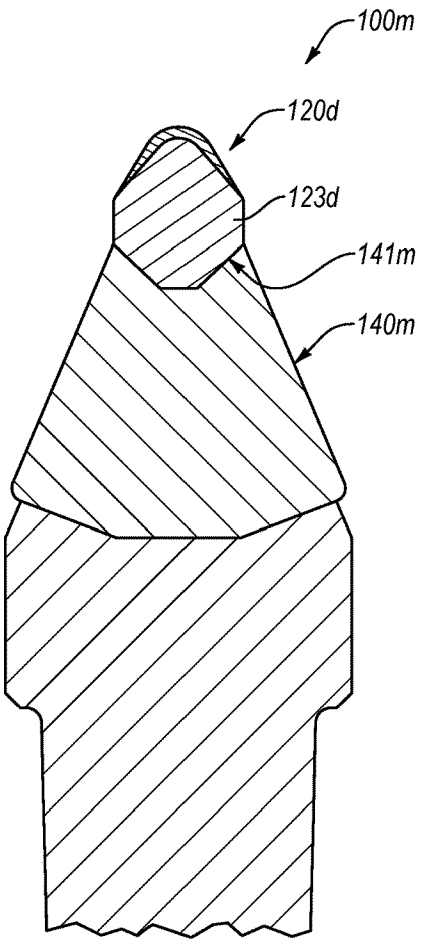
FIG. 12 is a partial cross-sectional view of a cutting tool assembly according to another embodiment.

Alternatively, as shown in FIG. 12, a cutting tool assembly 100*m* may include a bolster body 140*m* that may have an at least partially tapered recess 141*m* that may accommodate complementary shaped cutting element 120*d*, according to an embodiment. Except as otherwise described herein, the cutting tool assembly 100*m* and its materials, features, elements, or components may be similar to or the same as any of the cutting tool assemblies 100, 100*a*, 100*b*, 100*c*, 100*d*, 100*e*, 100*f*, 100*g*, 100*h*, 100*k* (FIGS. 1A-11) and their respective materials, features, elements and components. In an embodiment, the recess 141*m* may include a tapered portion and a substrate 123*d* of the cutting element 120*d* may include a corresponding or complementary tapered portion. In some embodiments, the tapered portions of the cutting element 120*d* and the recess 141*k* may position and/or orient the cutting element 120*d* and the bolster body 140*k* relative to each other.

Figure 13A:
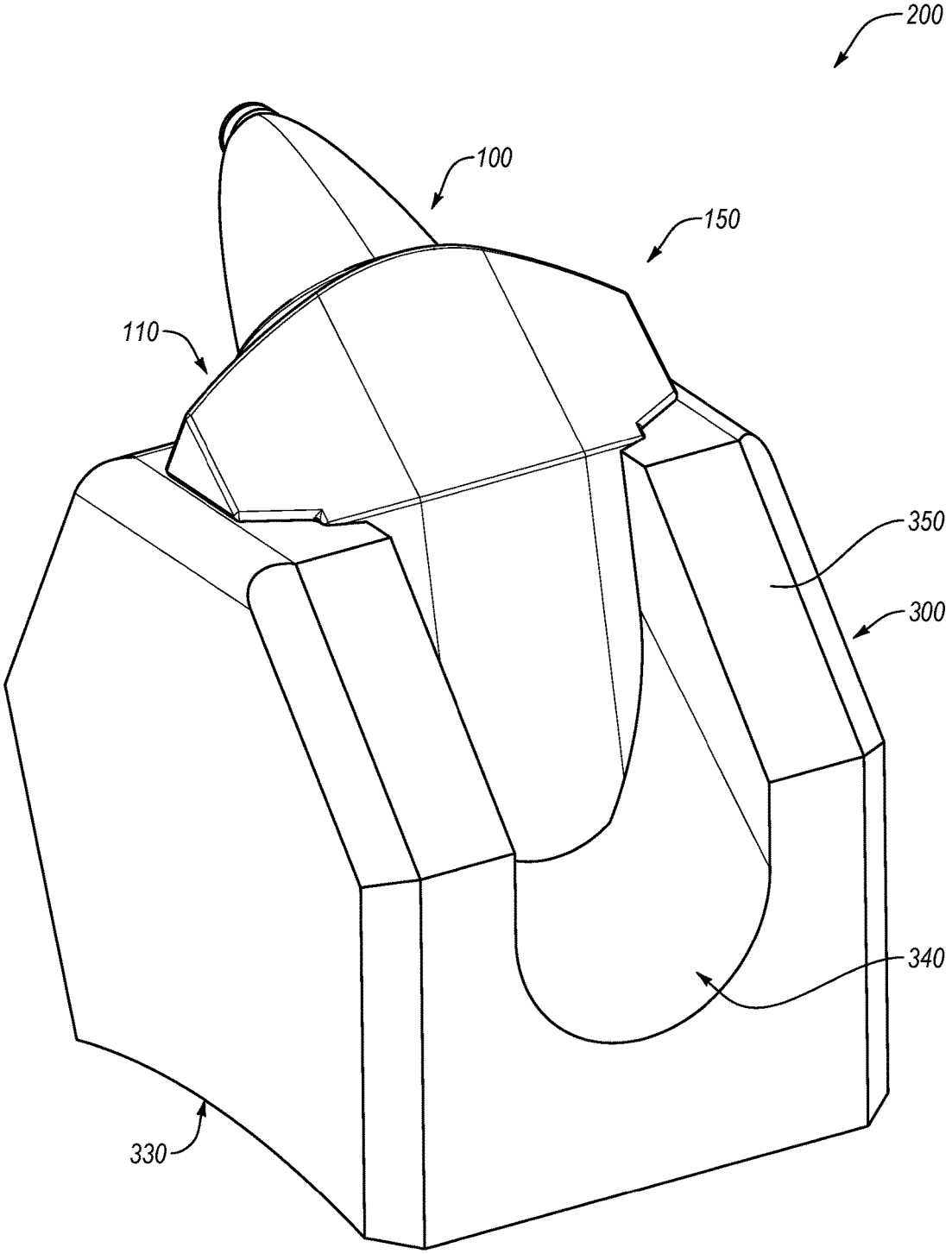
FIG. 13A is a back isometric view of a cutting tool mounting assembly according to an embodiment.
Figure 13B:
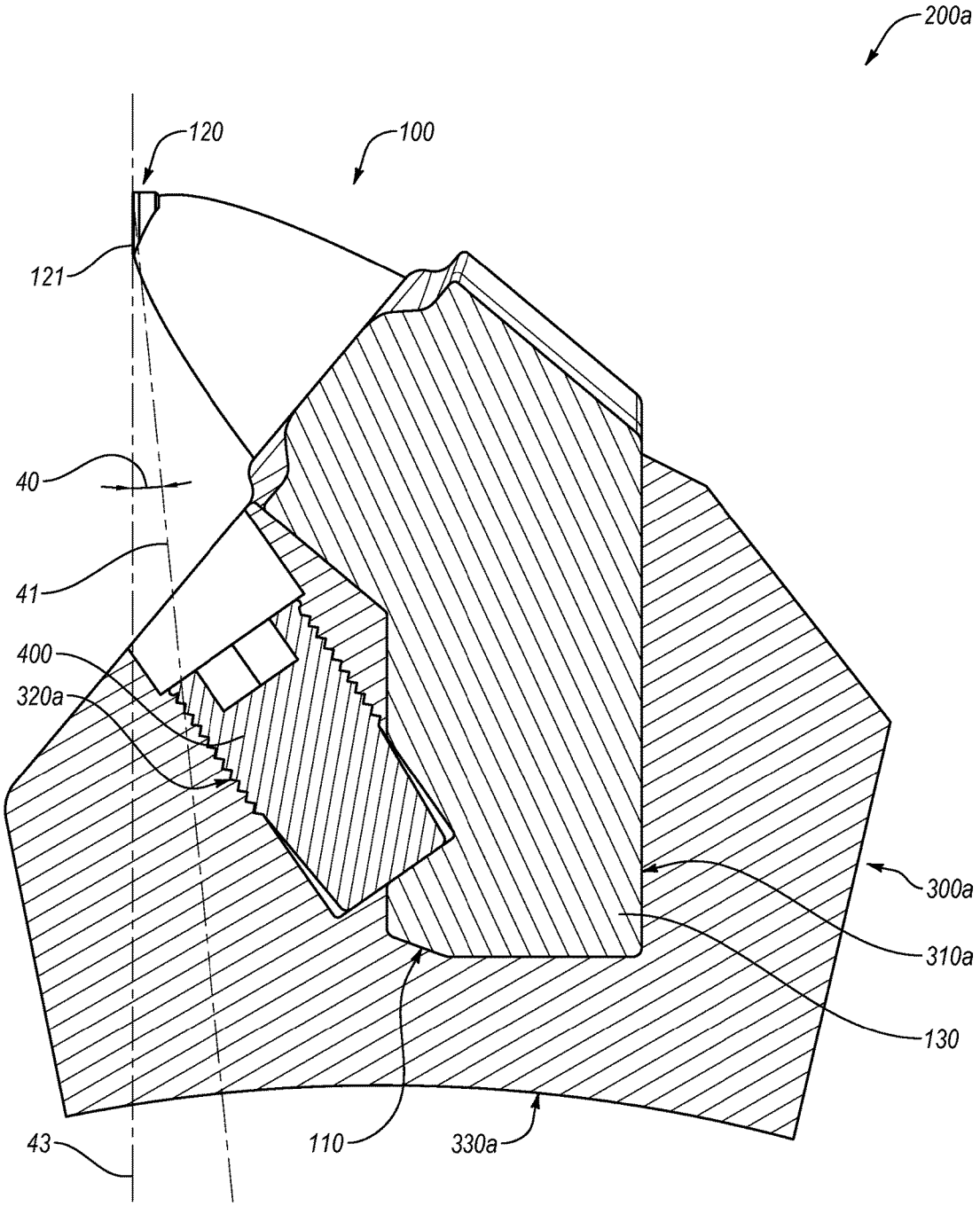
FIG. 13B is a cross-sectional view of the cutting tool mounting assembly of FIG. 13A.

FIGS. 13A and 13B illustrate a cutting tool mounting assembly 200 that includes the cutting tool assembly 100 (FIGS. 1A-1B) and a base body 300 secured together, according to different embodiments. In particular, FIG. 13A is back isometric view of the cutting tool mounting assembly 200 according to an embodiment, and FIG. 13B is a cross-sectional view of a cutting tool mounting assembly 200*a*. Except as otherwise described herein, the cutting tool mounting assembly 200 (FIG. 13A) and its materials, components, elements, or features may be similar to or the same as the cutting tool mounting assembly 200*a* (FIG. 13B) and its corresponding materials, components, elements, and features. It should be appreciated that, while the following description relates to the cutting tool assembly 100, which is secured to the base body 300, any cutting tool assembly described herein may be secured to and/or within the base body 300. In an embodiment, the base body 300 may include a tool recess (e.g., similar to or the same as tool recess 310*a* (FIG. 13B)) that may be sized and configured to accept the support block 110 of the cutting tool assembly 100. Generally, the tool recess may be sized, shaped, or otherwise configured to complement the shape of the support block 110. For example, a portion of the tool recess may be sized and/or shaped to accommodate insertion of the elongated mounting shank 130.

Moreover, the base body 300 may include a recess that may accommodate a fastener (e.g., similar to or the same as recess 320*a* and fastener 400 (FIG. 13B)) that may secure the support block 110 within the tool recess 310, thereby securing the cutting tool assembly 100 to the base body 300. In an embodiment, the base body 300 may include a recess 340 on a back side thereof. In the illustrated embodiment, the support block 110 is solid or monolithic (e.g., without recess(es)), such that the recess 340 in the base body 300 extends from the mounting shank of the support block 110.

As described above, in at least one embodiment, the support block 110 may include the recess that facilitate channeling the flow or movement of failed material away from the cutting tool assembly 100. In some embodiments, The recess 340 may extend between the recess of the support block 110 and an outer or peripheral surface of the base body 300. For example, the failed material may enter the recess in the support block 110, move or flow into the recess 340 in the base body 300, and further move out of the recess 340 and away from the cutting tool mounting assembly. Moreover, in some embodiments, the base body 300 may include a slanted surface 350 that may partially defined the periphery of the base body 300, and which may generally extend from one or more peripheral surfaces of upper portion 150 of the support block 110. For example, the failed material may move along one or more portions of the peripheral surfaces of the upper portion 150, onto the slanted surface 350 of the base body 300, and away from the cutting tool mounting assembly 200.

Generally, the base body 300 may be mounted and/or secured to a rotary drum in any number of suitable ways. In an embodiment, the base body 300 may include a curved surface (e.g., similar to or the same as curved surface 330*a* of base body 300*a* (FIG. 13B)) that may be complementary to and/or match a corresponding surface of a rotary drum of a material-removal machine (e.g., the base body 300 and/or the base body 300*a* (FIG. 13B) may be mounted on an outer surface of the rotary drum, as described below in more detail).

As shown in FIG. 13B, in at least one embodiment, the cutting tool mounting assembly 200*a* includes a base body 300*a* and the cutting tool assembly 100 is secured thereto (e.g., in a manner described above in connection with FIG. 13A). In some embodiments, when the cutting tool mounting assembly 200*a* is secured to the rotary drum, the superhard working surface 121 (as shown extended by imaginary line 43) of the cutting element 120 may be positioned at a rake angle 40 relative to an imaginary radial line 41 extending from a center of rotation of the rotary drum. For example, the rake angle 40 may be a negative rake angle (as shown in the illustrated embodiment). Alternatively, the rake angle 40 may be a positive rake angle.

Moreover, as mentioned above, the cutting tool assembly may include multiple cutting elements. In some embodiments, one, some, or all of the cutting elements may have a positive or negative rake angle and/or a positive or a negative clearance angle. Moreover, the rake angles of two, some, or all the multiple cutting elements may be the same as one another or different from one another. In an embodiment, some of the cutting elements may have a positive rake angle, while other cutting elements may have a negative rake angle. Generally, rake angle may be any suitable angle (e.g., the rake angle may be any angle from −20 degrees to 20 degrees). However, the clearance angle will generally be positive (e.g., from 1 degree to 20 degrees; from 15 degrees to 25 degrees; from 25 degrees to 40 degrees, etc.).

In an embodiment, as shown in FIG. 13B, the tool recess 310*a* in the base body 300*a* may contact the mounting shank substantially about the entire peripheral surface thereof (e.g., the base body 300*a* may be without a recess (such as the recess described above in connection with base body 300 (FIG. 13A)). In some embodiments, the base body 300*a* may have one or more openings or holes extending from an outer or peripheral surface thereof to the support block 110 of the cutting tool assembly 100. For example, the openings or holes may be sized and positioned to facilitate removal of the cutting tool assembly 100 from the base block 300 (e.g., a knocker or a knock-out rod may be placed into the opening and an impact may be transferred thereby to the cutting tool assembly 100, in a manner that dislodges and/or at least partially removes the support block 110 from the tool recess 310*a*).

Figure 14:
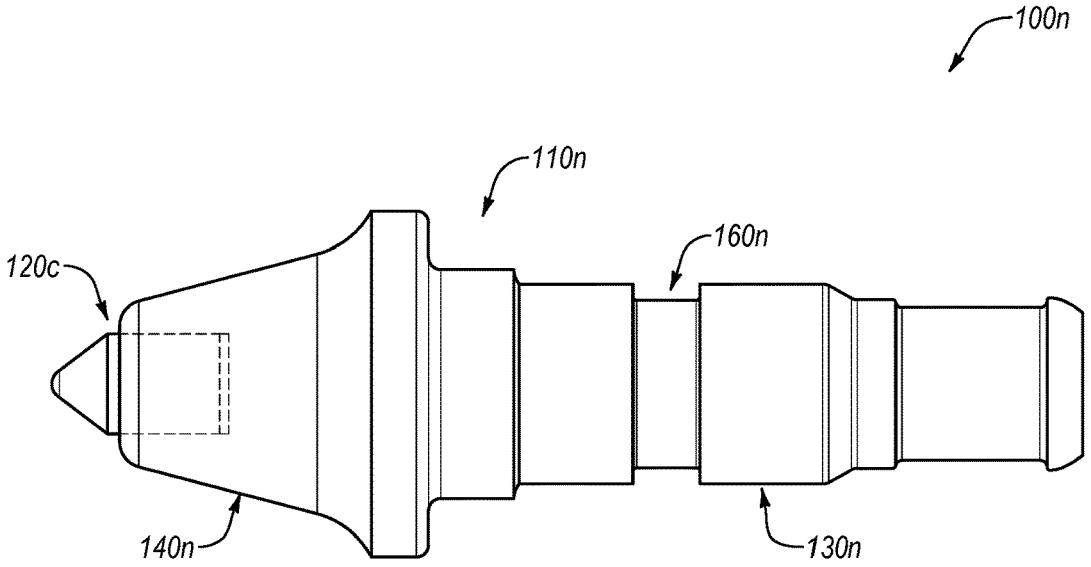
FIG. 14 is side view of a cutting tool assembly according to an embodiment.

The cutting tool assembly and its elements and components (e.g., the support block and/or the bolster body of the cutting tool assembly) may have any number of suitable shapes and may include one or more features for a fastening tool (e.g., for a wrench). As shown in FIG. 14, a cutting tool assembly 100*n* may be generally straight or linearly configured (e.g., the support block 110*n*, including the elongated mounting shank 130*n* thereof, and bolster body 140*n* may be generally linearly aligned with each other), according to an embodiment. Except as otherwise described herein, the cutting tool assembly 100*n* and its materials, features, elements, or components may be similar to or the same as any of the cutting tool assemblies 100, 100*a*, 100*b*, 100*c*, 100*d*, 100*e*, 100*f*, 100*g*, 100*h*, 100*k*, 100*m* (FIGS. 1A-12) and their respective materials, features, elements and components.

In some embodiments, at least a portion of the support block 110*n* may be generally cylindrical (e.g., the elongated mounting shank 130*n* may be generally cylindrical). In an embodiment, the elongated mounting shank 130*n* may include one or more recesses, which may accommodate securing the cutting tool assembly 100*n* to a base body (e.g., as described below in more detail). For example, the support block 110*n* may include a recess 160*n* that may accommodate a ring (e.g., a snap ring), a pin, or another expandable mechanical fastener or any other mechanical fastener that may secure the cutting tool assembly 100*n* to the base body.

Figure 15:
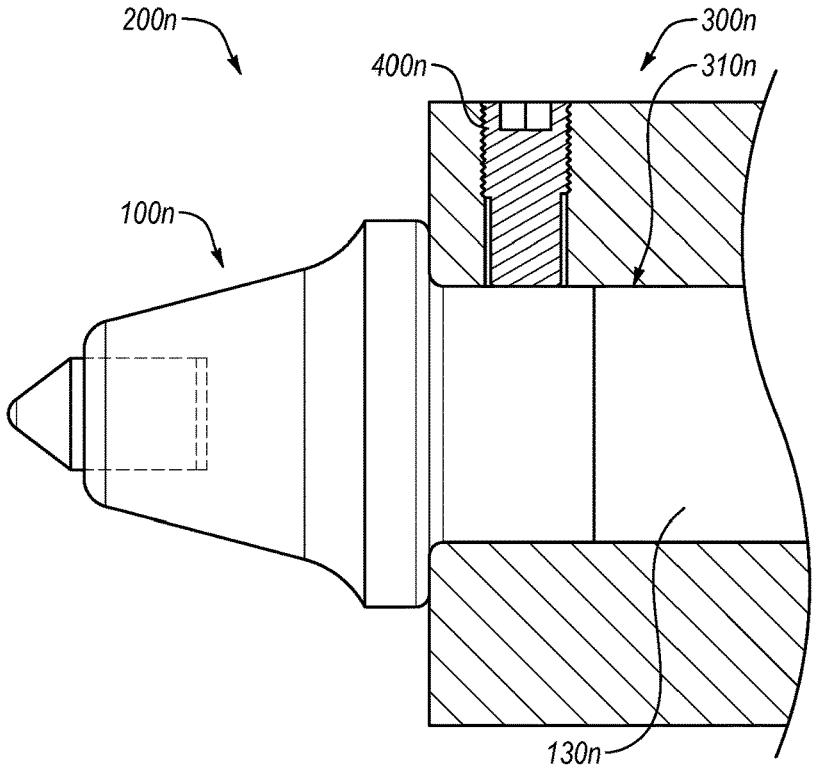
FIG. 15 is a partial cross-sectional view of a cutting tool mounting assembly according to an embodiment.

Alternatively or additionally, the cutting tool assembly 100*n* may be secured to the base body with one or more fasteners. FIG. 15 illustrates a cutting tool mounting assembly 200*n* that includes the cutting tool assembly 100*n* and a base body 300*n* secured together, according to an embodiment. Except as otherwise described herein, the cutting tool mounting assembly 200*n* and its materials, features, elements, or components may be similar to or the same as the cutting tool mounting assembly 200 (FIG. 13) and its corresponding materials, features, elements, and components. For example, the base body 300*n* may include a tool recess 310*n* that may be sized, shaped, and otherwise configured to accept the elongated mounting shank 130*n* of the cutting tool assembly 100*n*.

In some embodiments, the cutting tool assembly 100*n* may be secured to the base body 300*n* with a fastener 400*n*. For example, the fastener 400*n* may secure the elongated mounting shank 130*n* of the cutting tool assembly 100*n* in the tool recess 310*n* of the base body 300*n*. As mentioned above, in an embodiment, the cutting tool mounting assembly 200*n* may include one or more fasteners (e.g., snap rings, pins, etc.) or other mechanical fasteners that may secure the cutting tool assembly 100*n* to and/or within the base body 300*n*. Furthermore, the cutting tool assembly 100*n* may be welded, brazed, or otherwise bonded and/or secured to the base body 300*n*. While in some embodiments the cutting tool assemblies described herein may be secured to a base body that is secured to the rotary drum of a material-removal machine, in one or more additional or alternative embodiment, any of the cutting tool assemblies described herein may be directly secured to the rotary drum of the material-removal machine.

Figure 16:
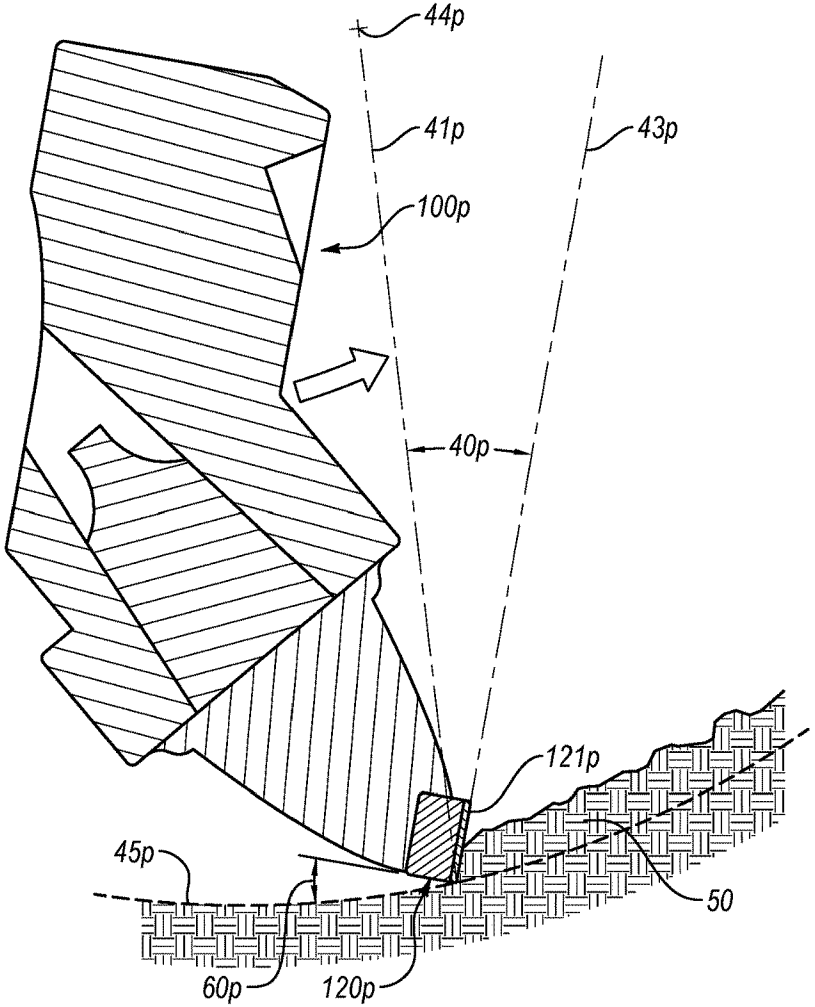
FIG. 16 is a schematic cross-sectional view of a cutting tool assembly in operation according to an embodiment.

FIG. 16 illustrates a cutting tool assembly 100*p* in operation according to an embodiment. For clarity, the cutting tool assembly 100*p* is shown without a base body and not mounted on a rotary drum. It should be appreciated that the cutting tool assembly 100*p* may be mounted to any base body described herein and may be mounted to a rotary drum that may rotate the cutting tool assembly 100*p* about an axis. Except as otherwise described herein, the cutting tool assembly 100*p* and its materials, features, elements, or components may be similar to or the same as any of the cutting tool assemblies 100, 100*a*, 100*b*, 100*c*, 100*d*, 100*e*, 100*f*, 100*g*, 100*h*, 100*k*, 100*m*, 100*n* (FIGS. 1A-12, 14-15) and their respective materials, features, elements and components.

As discussed above, the cutting tool assembly 100*p* may include a cutting element 120*p* that may have a generally planar, superhard working surface 121*p*. As the cutting tool assembly 100*p* advances in and/or fails material 50, the working surface 121*p* may have a suitable positive or negative rake angle or orientation, such as to facilitate clearing or moving the failed material away from the cutting element 120 and/or from the cutting tool assembly 100*p*. For example, rake angle 40*p* (illustrated as a negative rake angle) may be measured between an imaginary line 43*p*, which extends in a plane that is coplanar with the working surface 121*p*, and an imaginary line 41*p*, which extends from a center point 44*p* of rotation of the cutting tool assembly 100*p* to a point of intersection between the imaginary line 41*p* and a projected cut line 45*p*. The projected cut line 45*p* may be generally circular and may be defined by a path of a point or portion of the working surface 121 that is farthest from the center point 44*p*, as that farthest point moves about the center point 44*p*. In one or more embodiments, the magnitude of the rake angle 40*p* (negative or positive) may be in one or more of the following ranges: from about 5 degrees to about 15 degrees; from about 15 degrees to about 25 degrees, from about 25 degrees to about 40 degrees. Moreover, the rake angle 40*p* may be greater than about 40 degrees or less than about 5 degrees.

In some embodiments, the cutting element 120 may be positioned and/or oriented such as to form a clearance angle 60*p* between a lowest portion of the outer or peripheral surface (e.g., farthest away from center point 44*p*) and the projected cut line 45*p*. Note that while the projected cut line 45*p* may be generally circular, the circumference of the projected cut line 45*p* may be such that at the locations near the cutting element 120*p* (e.g., at a distance from the cutting element 120*p* that is equal to the 1×, 2×, 3×, etc., the size of the cutting element 120*p*) the projected cut line 45*p* may be approximated by a linear segment. In one or more embodiments, the clearance angle 60*p* may be in one or more of the following ranges, from about 5 degrees to about 15 degrees, from about 15 degrees to about 25 degrees, from about 25 degrees to about 40 degrees. Moreover, the clearance angle 60*p* may be greater than about 40 degrees or less than about 5 degrees.

Figure 17:
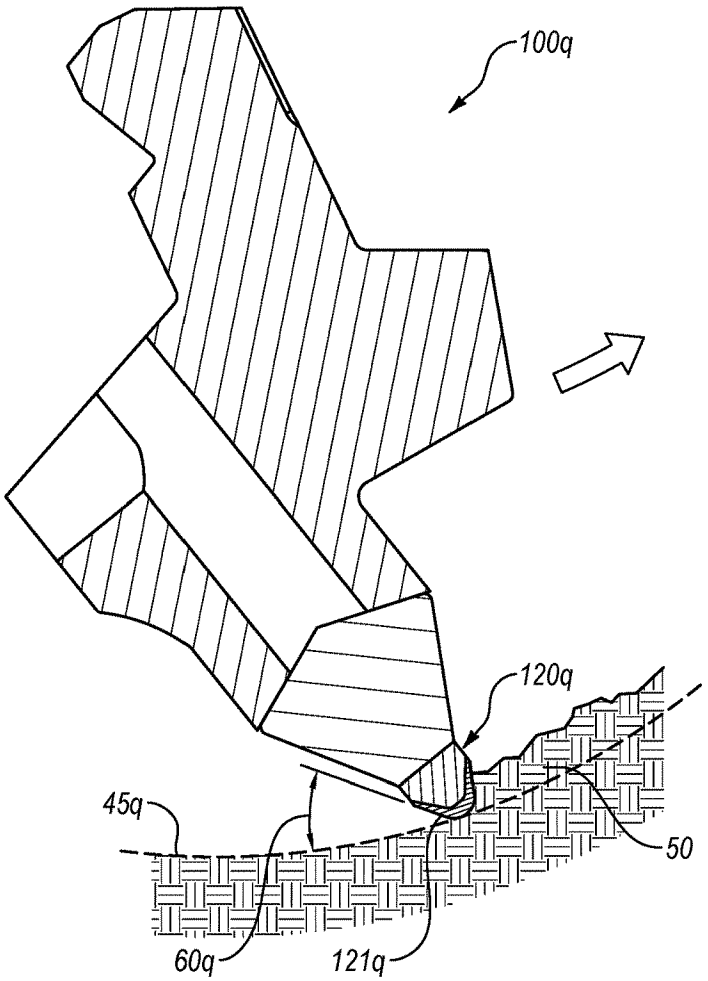
FIG. 17 is a schematic cross-sectional view of a cutting tool assembly in operation according to another embodiment.

FIG. 17 illustrates a cutting tool assembly 100*q* in operation according to another embodiment. Except as otherwise described herein, the cutting tool assembly 100*q* and its materials, features, elements, or components may be similar to or the same as any of the cutting tool assemblies 100, 100*a*, 100*b*, 100*c*, 100*d*, 100*e*, 100*f*, 100*g*, 100*h*, 100*k*, 100*m*, 100*n*, 100*q* (FIGS. 1A-12, 14-16) and their respective materials, features, elements and components. For example, as described above, the cutting tool assembly 100*q* may include a cutting element 120*q*, which may have a non-planar working surface, such as a dome-shaped working surface 121*q*.

In some embodiments, a portion of the working surface 121*q* may be generally conical. For example, the conical portion of the working surface 121*q* may form a clearance angle 60*q* with projected cut line 45*q*. In one or more embodiments, the clearance angle 60*q* may be in one or more of the following ranges, from about 5 degrees to about 15 degrees, from about 15 degrees to about 25 degrees, from about 25 degrees to about 40 degrees. Moreover, the clearance angle 60*q* may be greater than about 40 degrees or less than about 5 degrees.

Also, in at least one embodiment, the cutting tool assembly 100*q* may be angled relative to the material 50 and/or relative to the projected cut line 45*q*. For example, the cutting tool assembly 100*q* may be oriented such that an imaginary line extending through the center of the cutting element 120*q* is non-perpendicular relative to the projected cut line 45*q* and/or relative to an imaginary line that is substantially tangent to the projected cut line 45*q*. As mentioned above, the circumference of the imaginary cut line 45*q* may be sufficiently great, such that a segment of the projected cut line 45*q*, which is near the cutting element 120*q*, may be approximated as a linear segment.

Figure 18:
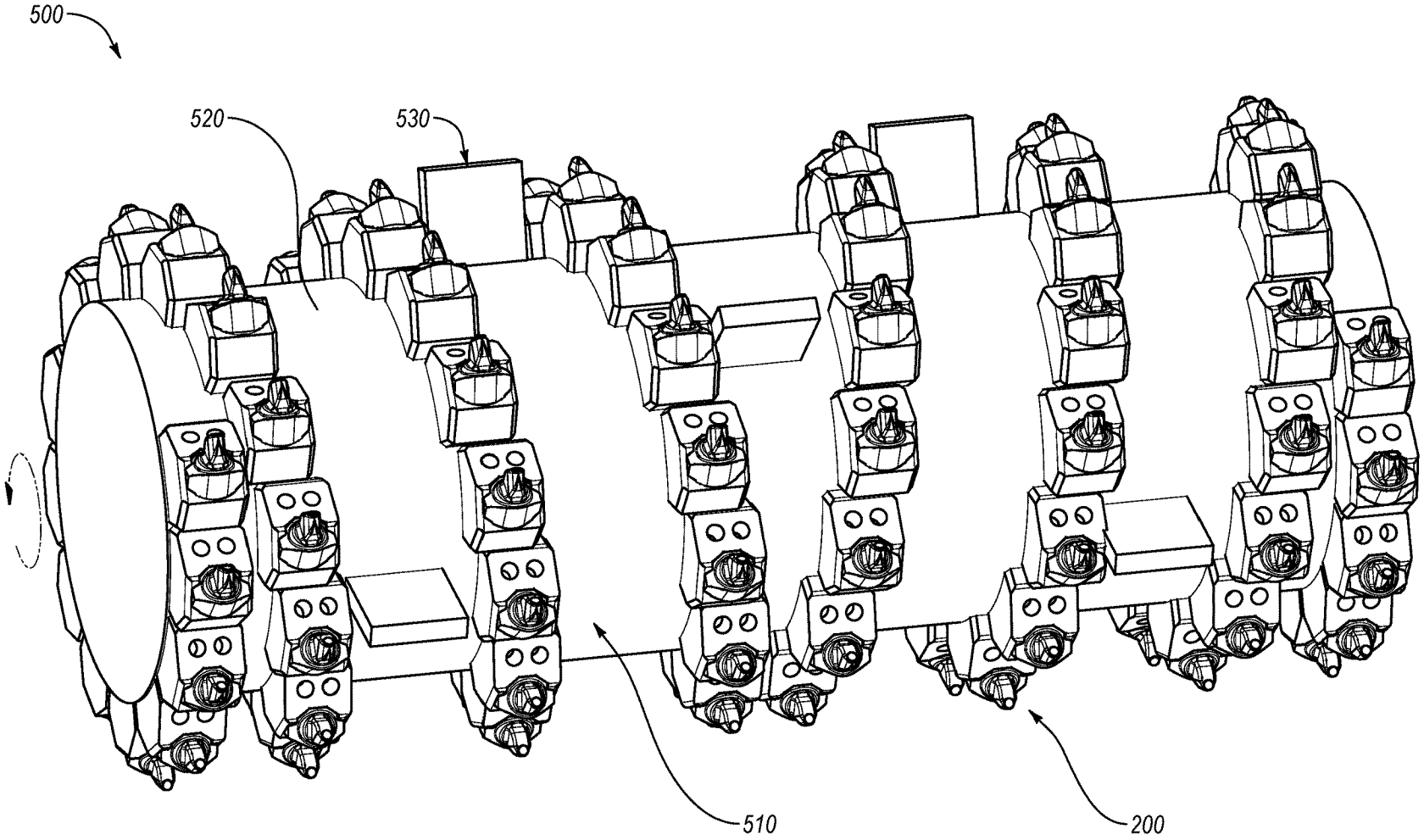
FIG. 18 is an isometric view of a rotary drum assembly according to an embodiment.

FIG. 18 illustrates an embodiment of a rotary drum assembly 500, which may include any number of cutting tool assemblies, such as cutting tool mounting assembly 200. As described above, the cutting tool mounting assembly 200 may include cutting tool assembly 100 secured to the base body 300. It should be appreciated, however, that the rotary drum assembly 500 may include any of the cutting tool assemblies and/or corresponding base bodies described herein and combinations thereof. In addition, the rotary drum assembly 500 may include one or more conventional cutting tools (e.g., conventional tools that do not include a superhard working surface).

In an embodiment, the rotary drum assembly 500 includes a drum body 510 that may have an outer surface 520, which may have a substantially cylindrical shape. It should be appreciated that the shape of the outer surface 520 may vary from one embodiment to the next. For example, the outer surface 520 may have oval or other non-cylindrical shapes. As described above, the base body 300 may be mounted on the outer surface 520 of the drum body 510 (e.g., the base body 300 may be welded to the drum body 510). In addition, the drum body 510 may be solid, hollow, or tubular (e.g., the drum body 510 may have a cored-out inner cavity or space). In any event, the drum body 510 may have sufficient strength and rigidity to secure the cutting tool mounting assemblies cutting tool mounting assembly 200 and to remove material, as may be suitable for a particular application.

Similarly, a cutting exterior of the rotary drum assembly 500, which may be formed or defined by the cutting tool mounting assemblies cutting tool mounting assembly 200, may have an approximate cylindrical shape. More specifically, superhard working surfaces of the cutting tool assemblies cutting tool assembly 100 (e.g., working surfaces of the cutting element 120 of the cutting tool assembly 100), collectively, may form an approximately cylindrical cutting exterior. It may be appreciated that the particular shape of the cutting exterior formed by the cutting tool assemblies cutting tool assembly 100 depend on the shape of the superhard working surfaces and on the orientation of the cutting tool assemblies cutting tool assembly 100 relative to the drum body 510, among other things.

Moreover, the cutting tool assemblies cutting tool assembly 100 have any number of suitable patterns and/or configurations on the drum body 510, which may vary from one embodiment to the next. For example, cutting tool assemblies cutting tool assembly 100 may form helical rows about the drum body 510, and such rows may wrap about the circumference of the drum body 510. In any event, the cutting exterior of the rotary drum assembly 500 may rotate about the center axis of the drum body 510 to cut, grind, or otherwise fail the target material by engaging the target material with the cutting tool assemblies cutting tool assembly 100.

Additionally, the helical arrangement may facilitate movement of the failed material between the cutting tool mounting assemblies cutting tool mounting assembly 200 and removal thereof from a worksite. Also, the rotary drum assembly 500 may include one or more paddles 530 (e.g., as shown in FIG. 18). The paddles 530 may facilitate transferring of the failed material away from the worksite (e.g., to a conveyor belt in a material-removing machine).

Figure 19:
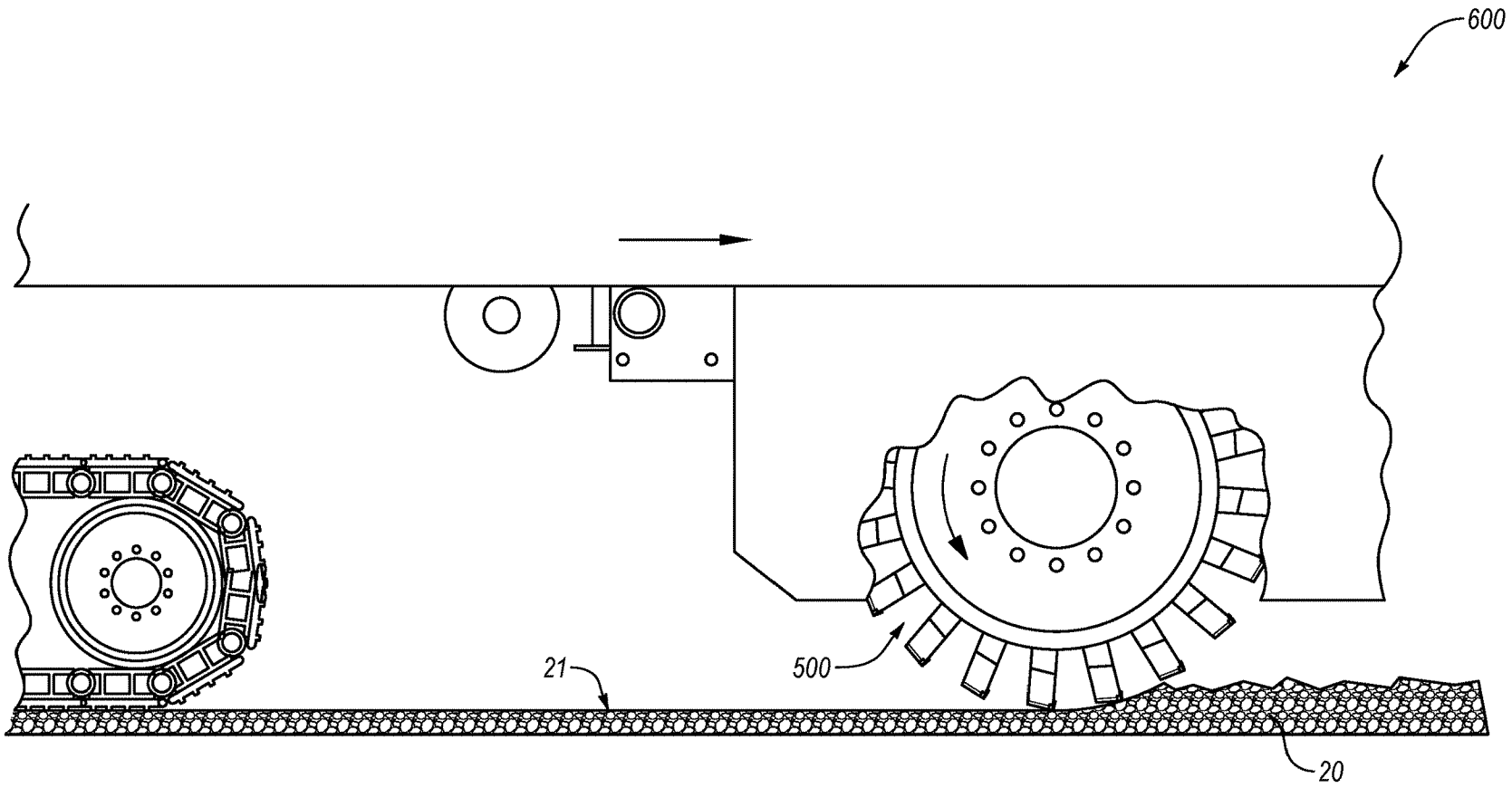
FIG. 19 is a side view of a material-removing machine according to an embodiment.

FIG. 19 illustrates an embodiment of a material-removal machine 600, which may incorporate the drum assembly 500. Particularly, as the material-removal machine 600 moves (e.g., in a direction indicated by an illustrated arrow), the drum assembly 500 may rotate in a manner that produces material failure and/or removal.

In some instances, the rotation of the drum assembly 500 and movement of the material-removing machine 600 may produce conventional cutting motion, where cutting tool assemblies engage the target material in the same direction as the direction of the movement of the material-removal machine 600 (i.e., as shown in FIG. 19). Alternatively, the rotation of the drum assembly 500 and movement of the material-removing machine 600 may produce a climb cutting motion, where the cutting tool assemblies of the drum assembly 500 engage the target material in a clockwise direction, with the direction of the material-removing machine 600, as shown in FIG. 19. Furthermore, in some instances, the material-removing machine 600 may engage material at a selected depth of cut. For example, the material-removing machine 600 may engage the target material at an unfinished, partial depth, or final finished depth, such as to achieve the selected depth. In any case, rotation of the drum assembly 500 together with the movement of the material-removal machine 600 may remove at least a portion of the target material.

In an embodiment, movement of the material-removal machine 600 together with the rotation of the drum assembly 500 may remove a portion of a pavement 20, thereby producing a cut surface 21. Removed pavement may be subsequently recycled. Additionally or alternatively, the material-removal machine 600 may remove material in any number of suitable applications, including above ground and underground mining.

It should be noted that any of the cutting tool assemblies and cutting tool mounting assemblies disclosed herein may be employed on other types of material removal systems besides the drum assembly 500 and the material-removal machine 600. For example, any of the cutting tool assemblies and cutting tool mounting assemblies disclosed herein may be employed on a long-wall material removal system or any material-removal system disclosed in U.S. Patent Application Nos. 62/030,525, the disclosure of which is incorporated herein, in its entirety, by this reference.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

We claim:

1. A cutting tool assembly configured for attachment to a base body on a rotatable assembly of a material-removal machine, the base body having a tool recess and an outer upper surface outside the tool recess, the cutting tool assembly comprising:

a support block including:

an elongated mounting shank having a vertical axis sized and configured to be secured at least partially within the tool recess of the base body; and an upper portion configured to be positioned outside the base body when the elongated mounting shank is secured at least partially within the tool recess of the base body, the upper portion including two opposing shoulders extending away from the vertical axis beyond the elongated shank in corresponding opposing lateral directions and positioned to contact the outer upper surface of the base body when the elongated mounting shank is secured at least partially within the base body;

a bolster body secured to the support block, the bolster body extending away from the vertical axis in a direction that is generally non-parallel to the opposing lateral directions; and a cutting element secured to and positioned at least partially within the bolster body, the cutting element having a superhard working surface that includes a superhard material, and the bolster body being sized and configured to protect at least a portion of the cutting element from at least one of erosion or wear during operation of the cutting tool assembly.

2. The cutting tool assembly of claim 1, wherein the upper portion has a greater peripheral size than the elongated mounting shank, and the bolster body is bonded to or integrated with the upper portion of the support block.

3. The cutting tool assembly of claim 2, wherein the support block includes a transition region extending between the bolster body and the upper portion of the support block.

4. The cutting tool assembly of claim 1, wherein:

the upper portion further includes a tapered through opening extending through the support block between the two opposing shoulders; and the bolster body includes a tapered shank that is complementary to and secured in the tapered through opening.

5. The cutting tool assembly of claim 1, wherein the bolster body is elongated and oriented at a non-perpendicular and a non-parallel angle relative to the elongated mounting shank.

6. The cutting tool assembly of claim 1, wherein the bolster body is at least partially defined by a first dimension along a direction substantially perpendicular to a direction of movement of the cutting tool assembly during operation, the first dimension substantially equal to a dimension of the cutting element.

7. The cutting tool assembly of claim 1, wherein the superhard working surface is substantially planar.

8. The cutting tool assembly of claim 7, wherein the cutting element is at least partially leached.

9. The cutting tool assembly of claim 1, wherein:

the upper portion includes an interface surface, a back side positioned opposite to the interface surface, and a through opening extending through the support block from the interface surface to the back side and positioned between the two opposing shoulders, the interface surface being angled towards the through opening;

the bolster body is bonded to the interface surface; and the cutting element includes:

a superhard table having the superhard working surface that includes the superhard material; and a substrate attached to the superhard table and attached to the bolster body opposite to the superhard table, the bolster body being sized and configured to protect at least a portion of a peripheral surface of the substrate from the at least one of erosion or wear during operation of the cutting tool assembly.

10. The cutting tool assembly of claim 1, wherein:

each of the two opposing shoulders includes a terminating edge extended beyond the elongated shank; and the upper portion includes an interface surface, a back side positioned opposite to the interface surface, and an upper surface between the interface surface and the back side, the upper surface being generally arcuate from the terminating edge of a first shoulder of the two opposing shoulders to the terminating edge of a second shoulder of the two opposing shoulders.

11. A cutting tool mounting assembly, comprising:

a base body sized and configured to be mounted to a material-removal machine, the base body including a tool recess and an outer upper surface outside of the tool recess; and a cutting tool assembly mounted to the base body, the cutting tool assembly including:

a support block including:

an elongated mounting shank having a vertical axis and positioned at least partially in the tool recess of the base body; and an upper portion positioned outside the base body, the upper portion including two opposing shoulders extending away from the vertical axis beyond the elongated shank in corresponding opposing lateral directions and contacting the outer upper surface of the base body;

a bolster body secured to the support block, the bolster body extending away from the vertical axis in a direction that is generally non-parallel to the opposing lateral direction; and a cutting element secured to and positioned at least partially within the bolster body, the cutting element having a superhard working surface that includes a superhard material, and the bolster body being sized and configured to protect at least a portion of the cutting element from at least one of wear or erosion during operation of the cutting tool assembly.

12. The cutting tool mounting assembly of claim 11, wherein the base body has an additional recess on a back side thereof positioned between the two opposing shoulders and extending between the through opening of the support block and a peripheral surface of the base body.

13. The cutting tool mounting assembly of claim 11, wherein the base body includes a curved surface sized and configured to be positioned on an outer surface of a rotary drum of the material-removal machine.

14. The cutting tool mounting assembly of claim 11, further comprising a fastener securing the cutting tool assembly to the base body.

15. The cutting tool mounting assembly of claim 11, wherein the superhard working surface of the cutting element is substantially planar.

16. The cutting tool mounting assembly of claim 15, wherein the cutting tool assembly is positioned relative to the base body to orient the substantially planar superhard working surface at a predetermined clearance angle and one of a predetermined negative rake angle or a positive rake angle.

17. The cutting tool mounting assembly of claim 11, wherein:

the upper portion includes an interface surface, a back side positioned opposite to the interface surface, and a through opening extending through the support block from the interface surface to the back side and positioned between the two opposing shoulders, the interface surface being angled towards the through opening;

the bolster body is bonded to the interface surface; and the cutting element includes:

a superhard table having the superhard working surface that includes the superhard material; and a substrate attached to the superhard table and attached to the bolster body opposite to the superhard table, the bolster body being sized and configured to protect at least a portion of a peripheral surface of the substrate from the at least one of wear or erosion during operation of the cutting tool mounting assembly.

18. The cutting tool mounting assembly of claim 17, wherein the through opening is a tapered opening and the bolster body includes a tapered shank that is complementary to and secured in the tapered opening.

19. A rotary assembly, comprising:

a rotary body including an outer surface; and a plurality of cutting tool mounting assemblies mounted to the rotary body, each of the plurality of cutting tool mounting assemblies including:

a base body mounted to the outer surface of the rotary body, the base body including a tool recess and an outer upper surface outside the tool recess; and a cutting tool assembly mounted to the base body, the cutting tool assembly including:

a support block including an elongated mounting shank positioned in the tool recess of the base body and an upper portion positioned outside the base body, the elongated mounting shank having a vertical axis and the upper portion including two opposing shoulders extending away from the vertical axis beyond the elongated shank in corresponding opposing lateral directions and contacting the outer upper surface of the base body;

a bolster body secured to the support block, the bolster body extending away from the vertical axis in a direction that is generally non-parallel to the opposing lateral directions; and a cutting element secured to and positioned at least partially within the bolster body, the cutting element having a superhard working surface that includes a superhard material, and the bolster body being sized and configured to protect at least a portion of the cutting element from at least one of wear or erosion during operation of the cutting tool assembly.

20. The rotary drum assembly of claim 19, wherein the superhard working surface is substantially planar and oriented at a positive or a negative rake angle relative to a line extending from a center point of rotation of the rotary body to a point of intersection between the line and a projected cut line.

21. The rotary drum assembly of claim 19, wherein:

the upper portion includes a tapered through opening extending through the support block between the two opposing shoulders;

the bolster body includes a tapered shank that is complementary to and secured in the tapered through opening; and the base body has an additional recess on a back side thereof positioned between the two opposing shoulders and extending between the through opening of the support block and a peripheral surface of the base body.

* * * * *